US009588466B2

(12) United States Patent
Oguni

(10) Patent No.: US 9,588,466 B2
(45) Date of Patent: Mar. 7, 2017

(54) IMAGE FORMING APPARATUS

(71) Applicant: CANON KABUSHIKI KAISHA, Tokyo (JP)

(72) Inventor: Atsushi Oguni, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/145,188

(22) Filed: May 3, 2016

(65) Prior Publication Data

US 2016/0246217 A1 Aug. 25, 2016

Related U.S. Application Data

(63) Continuation of application No. 14/532,434, filed on Nov. 4, 2014, now Pat. No. 9,354,556.

(30) Foreign Application Priority Data

Nov. 5, 2013 (JP) ..... 2013-229749

(51) Int. Cl.

| | |
|---|---|
| ***G03G 15/16*** | (2006.01) |
| ***G03G 15/01*** | (2006.01) |
| *G03G 21/18* | (2006.01) |
| *G03G 21/16* | (2006.01) |

(52) U.S. Cl.

CPC ..... *G03G 15/1605* (2013.01); *G03G 15/0136* (2013.01); *G03G 15/16* (2013.01); *G03G 21/1671* (2013.01); *G03G 21/181* (2013.01); *G03G 21/1821* (2013.01)

(58) Field of Classification Search

CPC ..... G03G 21/181; G03G 21/1671; G03G 21/1821; G03G 15/16; G03G 15/0136

See application file for complete search history.

(56) References Cited

U.S. PATENT DOCUMENTS

| | | | | |
|---|---|---|---|---|
| 9,354,556 | B2 * | 5/2016 | Oguni | G03G 15/16 |
| 2012/0195627 | A1 | 8/2012 | Kikuchi | |
| 2013/0223879 | A1 | 8/2013 | Onodera | |

FOREIGN PATENT DOCUMENTS

| | | | |
|---|---|---|---|
| CN | 1469208 | A | 1/2004 |
| CN | 102193472 | A | 9/2011 |
| JP | 2000-320537 | A | 11/2000 |
| JP | 2001-117467 | A | 4/2001 |

* cited by examiner

*Primary Examiner* — David Gray
*Assistant Examiner* — Michael Harrison
(74) *Attorney, Agent, or Firm* — Canon U.S.A. Inc., IP Division

(57) ABSTRACT

An image forming apparatus includes an image carrying member; a transfer unit that includes a transfer member, first and second separating portions configured to separate ends of the transfer member that are on one side and on another side, respectively, from the image carrying member; an engaging unit that includes first and second engaging portions configured to engage with the first and second separating portions, respectively, the engaging unit being configured to separate the transfer member from the image carrying member when the first engaging portion engages with the first separating portion and the second engaging portion engages with the second separating portion; and a regulating member configured to regulate a movement of the engaging unit. The engaging unit is moved by the regulating member from the one side toward the other side or from the other side toward the one side.

15 Claims, 25 Drawing Sheets

IMAGE FORMING APPARATUS

CROSS-REFERENCE TO RELATED APPLICATIONS

This application is a continuation of U.S. patent application Ser. No. 14/532,434 filed Nov. 4, 2014, which claims the benefit of Japanese Patent Application No. 2013-229749, filed Nov. 5, 2013, all of which are hereby incorporated by reference herein in their entirety.

BACKGROUND OF THE INVENTION

Field of the Invention

The present invention relates to an image forming apparatus, such as a copier, a printer, a facsimile apparatus, or a multifunction apparatus, configured to form an image electrophotographically.

Description of the Related Art

In an image forming apparatus employing an electrophotographic image forming process, an image is formed on a recording material, such as a sheet, in the following manner. First, an electrostatic latent image is formed on a photosensitive member as an image carrying member. The latent image is developed with developer and is thus visualized into a toner image. The toner image is transferred to the recording material at a transfer nip formed between the photosensitive member and a transfer member. The recording material having the toner image transferred thereto is nipped at and is conveyed through a fixing nip formed between a fixing roller and a pressure roller that are included in a fixing device, whereby the toner image is thermally fixed on the recording material. Thus, an image is formed on the recording material.

The transfer member is urged toward the photosensitive member by an urging member such that the transfer nip is formed between the transfer member and the photosensitive member. Therefore, the transfer member is in pressure contact with the photosensitive member. For example, with the photosensitive member and the transfer member being in pressure contact with each other, the image forming apparatus may be transported. In such a case, if the image forming apparatus is transported over a long time, the transfer member may be deformed or rubbed against the photosensitive member, or softener, cross-linker, or the like that has bled from the transfer member may adhere to the photosensitive member.

Japanese Patent Laid-Open No. 2010-262215 discloses an image forming apparatus in which, when helical gears provided at two respective axial ends of a photosensitive member are in mesh with helical gears provided at two respective axial ends of a transfer member, the photosensitive member and the transfer member are separated from each other. The image forming apparatus disclosed by Japanese Patent Laid-Open No. 2010-262215 is transportable with the transfer member being separated from the photosensitive member by the helical gears. Furthermore, when an image is to be formed, the helical gears at the two ends of the transfer member slide, whereby the helical gears on the transfer member are disengaged from the helical gears on the photosensitive member. At the disengagement of the helical gears, the transfer member comes into pressure contact with the photosensitive member.

In the apparatus disclosed by Japanese Patent Laid-Open No. 2010-262215, however, the helical gears provided at the two ends of the transfer member need to be moved individually. Therefore, it is difficult to assuredly bring the transfer member into contact with the photosensitive member.

Furthermore, in the apparatus disclosed by Japanese Patent Laid-Open No. 2010-262215, even if the transfer member is in pressure contact with the photosensitive member, the axial ends of the transfer member are constantly urged toward the inner side in the axial direction by the helical gears. Therefore, the transfer member is subject to an urging force even in the state of being in pressure contact with the photosensitive member. Consequently, the rotation of the transfer member may become unstable.

SUMMARY OF THE INVENTION

Accordingly, the present invention provides an image forming apparatus including an image carrying member and a transfer member that are separable from each other, and a separating mechanism that assuredly brings the transfer member into pressure contact with the image carrying member and stabilizes the rotation of the transfer member that is in pressure contact with the image carrying member.

According to an aspect of the present invention, an image forming apparatus includes an image carrying member that carries a toner image; a transfer unit that includes a transfer member configured to transfer the toner image from the image carrying member to a recording material, a first separating portion configured to separate an end of the transfer member that is on one side from the image carrying member, and a second separating portion configured to separate an end of the transfer member that is on another side from the image carrying member; an engaging unit that includes a first engaging portion configured to engage with the first separating portion, and a second engaging portion configured to engage with the second separating portion, the engaging unit being configured to separate the transfer member from the image carrying member when the first engaging portion engages with the first separating portion and the second engaging portion engages with the second separating portion; and a regulating member configured to regulate a movement of the engaging unit. The engaging unit is moved by the regulating member from the one side toward the other side or from the other side toward the one side.

Further features of the present invention will become apparent from the following description of exemplary embodiments with reference to the attached drawings.

DESCRIPTION OF THE EMBODIMENTS

Exemplary embodiments of the present invention will now be described in detail with reference to the attached drawings. The sizes, the materials, the shapes, the relative positions, and other factors of elements described in the following embodiments are to be changed appropriately in accordance with the configuration of and conditions set forth for an apparatus to which the present invention is applied. Hence, the scope of the present invention is not limited to the following embodiments unless specifically stated.

First Embodiment

Figure 1:
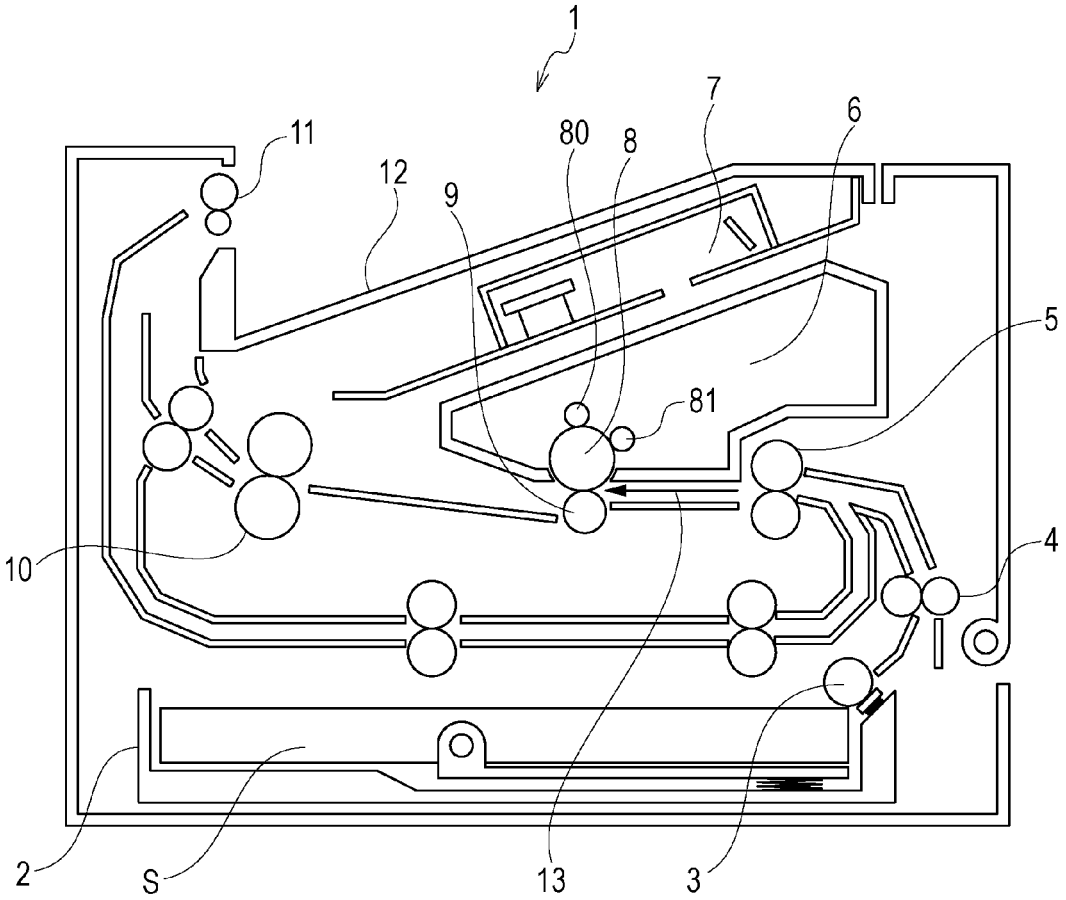
FIG. 1 is a schematic diagram of an image forming apparatus according to a first embodiment.

FIG. 1 is a schematic diagram of an exemplary image forming apparatus 1 according to a first embodiment. The image forming apparatus 1 is capable of electrophotographically forming an image on a recording material, such as a recording sheet or an over-head-projector (OHP) sheet, in accordance with a signal transmitted from an external apparatus, such as a personal computer, connected to the image forming apparatus 1 in such a manner as to be able to communicate with the image forming apparatus 1.

Overall Configuration of Image Forming Apparatus

FIG. 1 is a sectional view illustrating an outline configuration of the image forming apparatus 1 according to the first embodiment. The image forming apparatus 1 illustrated in FIG. 1 is an exemplary laser beam printer.

The image forming apparatus 1 includes a drum-type electrophotographic photosensitive member (hereinafter referred to as photosensitive drum 8) as an image carrying member. The photosensitive drum 8 includes a cylindrical drum base that is made of aluminum, nickel, or the like. A photosensitive agent, such as organic photoconductor (OPC), amorphous selenium, or amorphous silicon, is provided on the drum base. The photosensitive drum 8 is rotatably supported by a main body and is driven by a driving source in such a manner as to rotate at a predetermined process speed. The photosensitive drum 8 is surrounded by a charging member 80, a developing member 81, and a transfer roller 9 as a transfer member that are provided in that order in a direction of rotation of the photosensitive drum 8. Furthermore, a scanner unit 7 as an exposure unit is provided above the photosensitive drum 8. The photosensitive drum 8, the charging member 80, and the developing member 81 integrally constitute a process cartridge 6 that is detachably attached to the main body.

The image forming apparatus 1 also includes, in order along a conveyance path through which a recording material S is conveyed, a cassette 2 on which recording materials S such as pieces of paper are stacked, a feed roller 3, a pair of conveying rollers 4, a pair of registration rollers 5, a fixing unit 10, a pair of discharge rollers 11, and a discharge tray 12.

Operation of Image Forming Apparatus

An operation performed by the image forming apparatus 1 will now be described. The photosensitive drum 8 that is driven to rotate by the driving source is uniformly charged to have a predetermined polarity and a predetermined potential by the charging member 80. The surface of the photosensitive drum 8 thus charged is exposed to light emitted from the scanner unit 7 in accordance with image information. Electric charges on the exposed portion of the photosensitive drum 8 are thus removed, whereby an electrostatic latent image is formed. The electrostatic latent image is developed by the developing member 81, thereby being visualized into a toner image. The toner image on the photosensitive drum 8 is transferred to a recording material S by the transfer roller 9. The transfer roller 9 is urged toward the photosensitive drum 8 by an urging member to be described separately below. In such a configuration, a transfer nip is formed between the transfer roller 9 and the photosensitive drum 8. Thus, the transfer roller 9 transfers the toner image on the photosensitive drum 8 (the image carrying member) to the recording material S at the transfer nip.

Each of the recording materials S stacked and stored in the cassette 2 is fed from the cassette 2 by the feed roller 3. The recording material S is conveyed through the pair of conveying rollers 4 and the pair of registration rollers 5 to the transfer nip. An arrow 13 illustrated in FIG. 1 represents the direction of conveyance.

The toner image having been transferred from the photosensitive drum 8 to the recording material S at the transfer nip is thermally fixed by the fixing unit 10. The recording material S having passed through the fixing unit 10 is discharged onto the discharge tray 12 by the pair of discharge rollers 11.

Mechanism of Separating Transfer Roller from Photosensitive Drum

A mechanism of separating the transfer roller 9 from the photosensitive drum 8 will now be described.

Figure 2A:
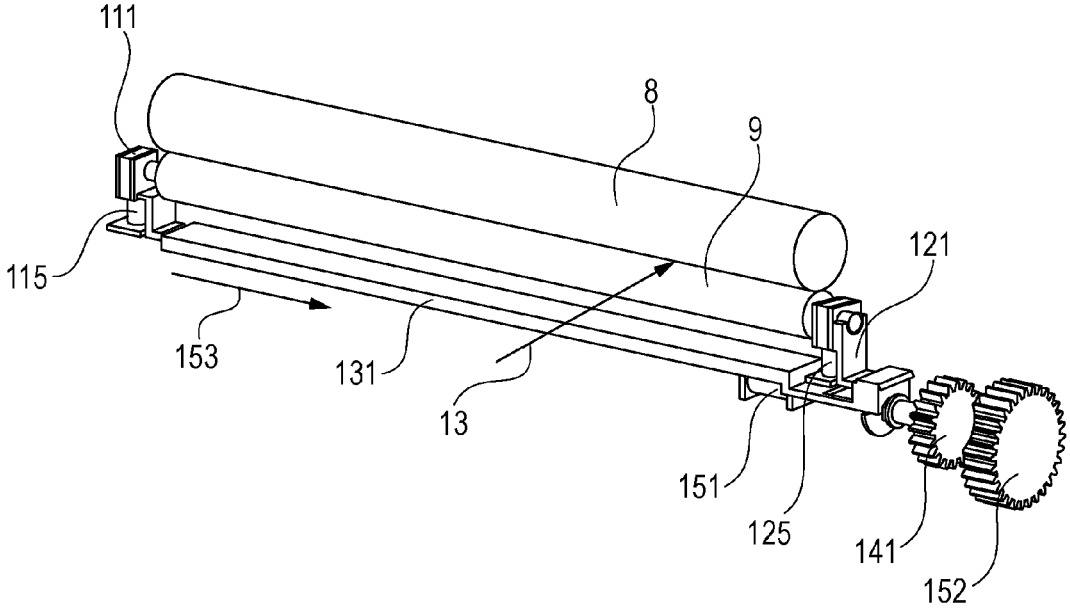
FIG. 2A is a schematic perspective view of a separating mechanism according to the first embodiment.
Figure 2B:
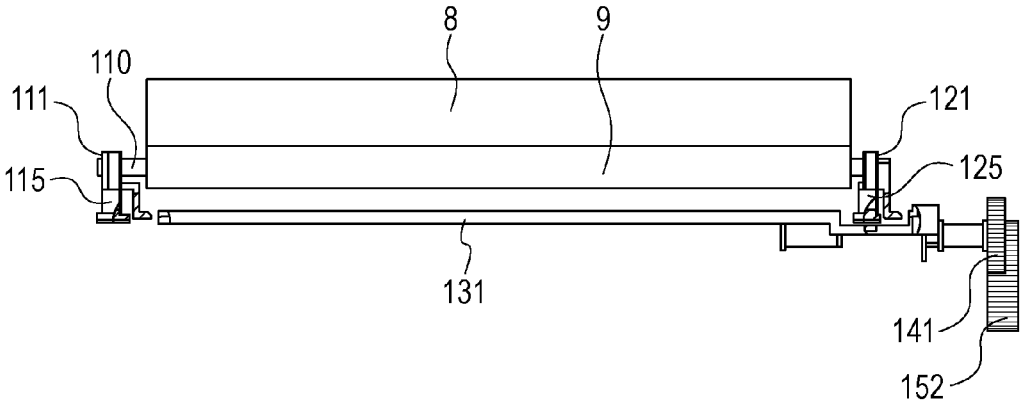
FIG. 2B is a schematic side view of the separating mechanism according to the first embodiment.

FIGS. 2A and 2B are each a schematic diagram of a separating mechanism according to the first embodiment, with the transfer roller 9 and the photosensitive drum 8 being in pressure contact with each other. A position (a pressure contact position) where the transfer roller 9 is in contact with the photosensitive drum 8 is referred to as a first position. A position where the transfer roller 9 is positioned farther from the photosensitive drum 8 than at the first position is referred to as a second position. In the first embodiment, the second position corresponds to a position where the transfer roller 9 is completely off the photosensitive drum 8. FIG. 2A is a perspective view of the transfer roller 9 and the photosensitive drum 8 that are in pressure contact with each other. FIG. 2B is a side view of the transfer roller 9 and the photosensitive drum 8 that are in pressure contact with each other.

Figure 3A:
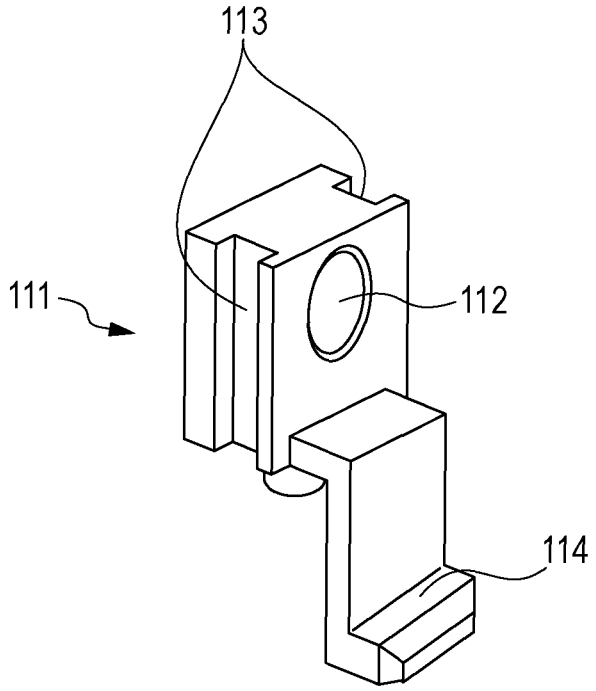
FIG. 3A illustrates a first bearing portion.
Figure 3B:
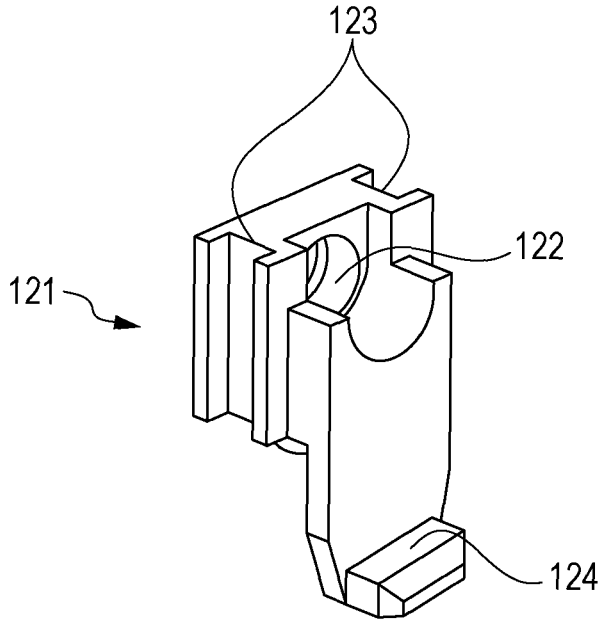
FIG. 3B illustrates a second bearing portion.
Figure 4A:
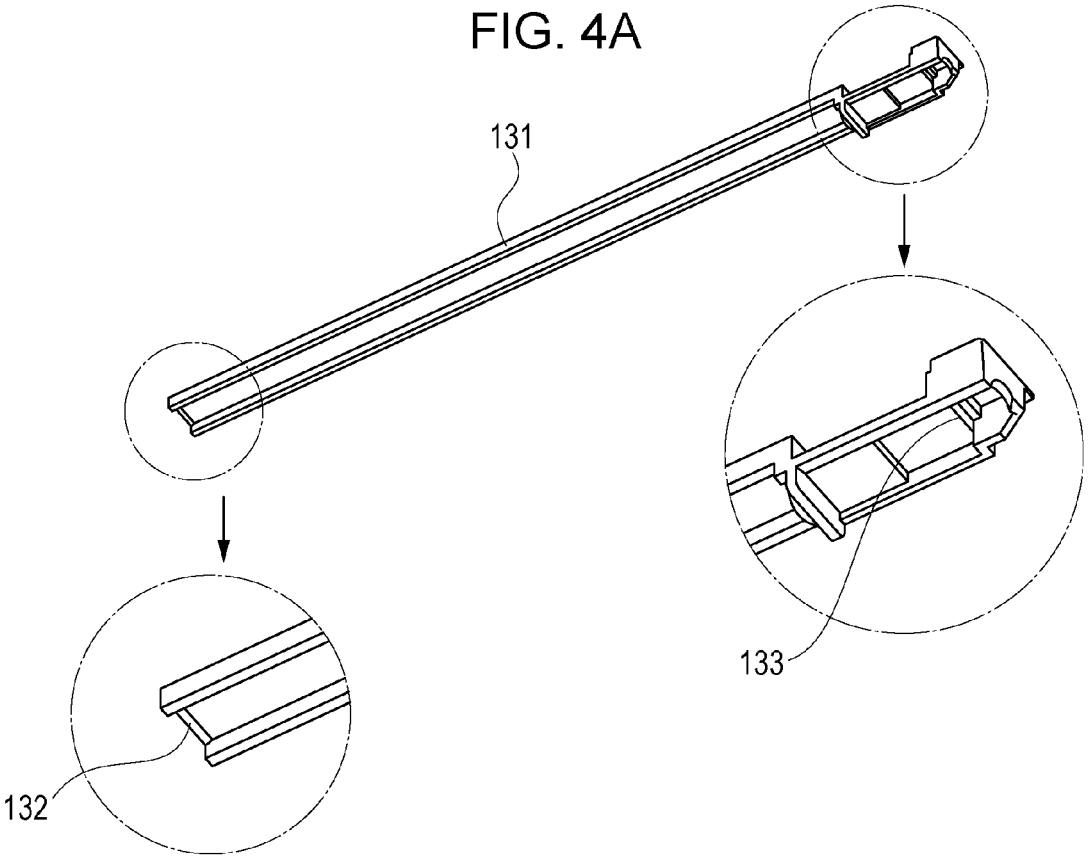
FIG. 4A illustrates the entirety of an engaging member according to the first embodiment with portions thereof illustrated in enlarged view.
Figure 4B:
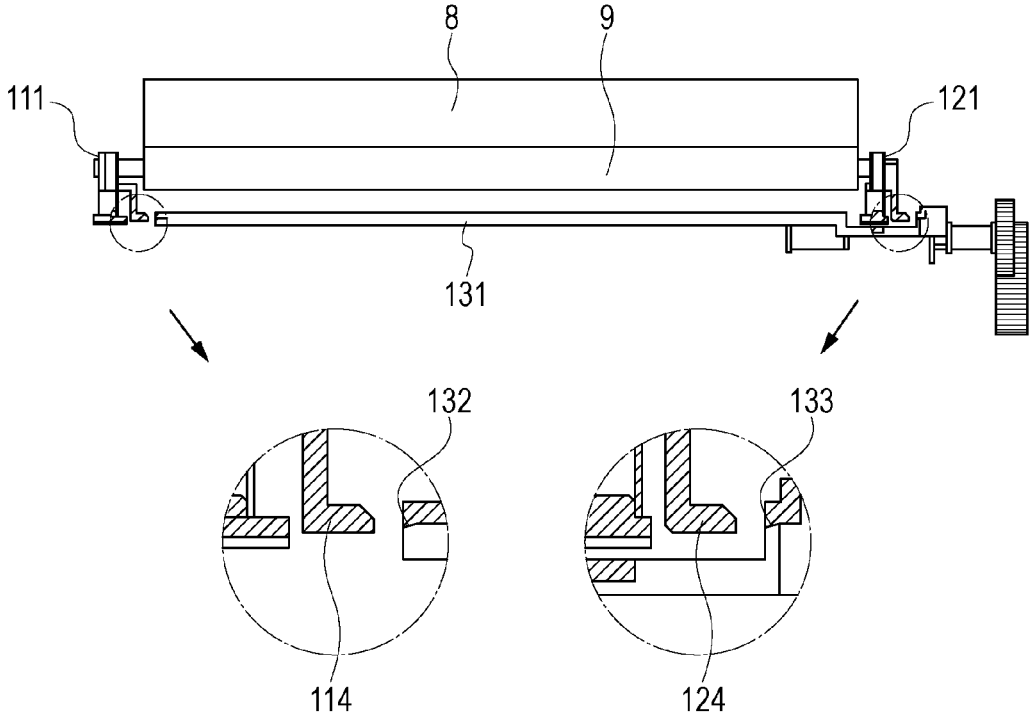
FIG. 4B illustrates a state of engagement between the engaging member and the bearing portions according to the first embodiment.
Figure 5A:
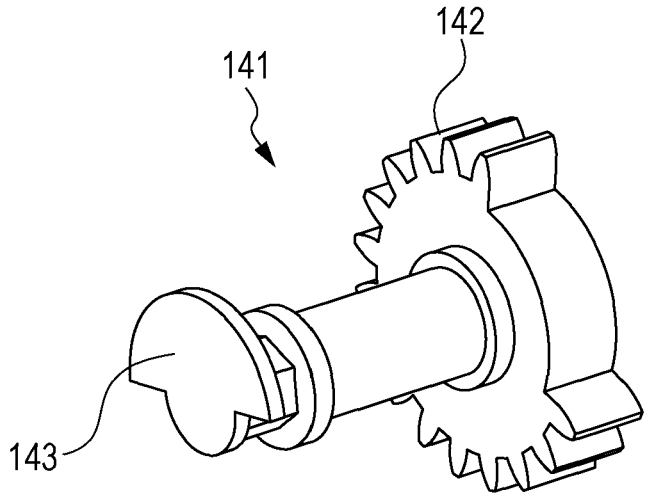
FIG. 5A illustrates the entirety of a regulating member according to the first embodiment.
Figure 5B:
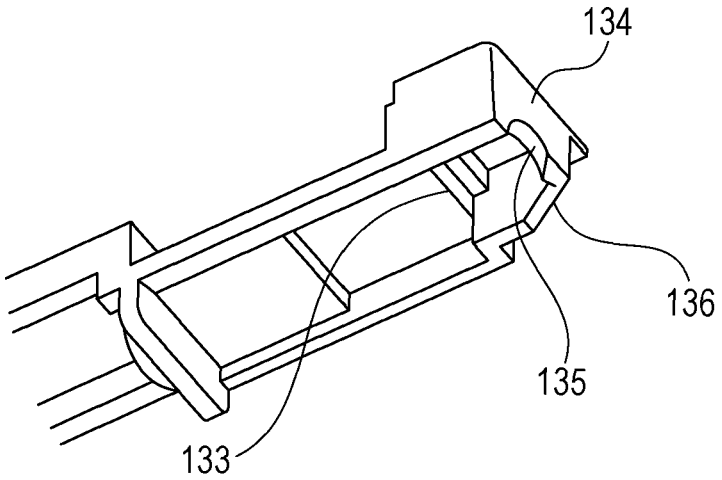
FIG. 5B illustrates an end of the engaging member that is configured to come into contact with the regulating member according to the first embodiment.

FIG. 3A illustrates a transfer roller bearing 111 as a first bearing portion. FIG. 3B illustrates a transfer roller bearing 121 as a second bearing portion. FIG. 4A illustrates the entirety of a locking member 131 as an engaging member with two ends thereof illustrated in enlarged view. FIG. 4B illustrates the positional relationship between an engaging unit and the bearing portions. FIG. 5A illustrates a stopper member 141 as a regulating member. FIG. 5B illustrates an end of the engaging unit that is configured to come into contact with the stopper member 141.

As illustrated in FIGS. 2A and 2B, the transfer roller 9 is rotatable about a rotating shaft 110 as a shaft portion. In the first embodiment, the transfer roller 9 follows the rotation of the photosensitive drum 8. Hereinafter, a direction that is orthogonal to the direction of conveyance 13 is defined as an axial direction. Two ends of the rotating shaft 110 in the axial direction are supported by the transfer roller bearing 111 as the first bearing portion and the transfer roller bearing 121 as the second bearing portion, respectively. The transfer roller bearing 111 is urged toward the photosensitive drum 8 by a spring 115 as a first bearing urging member. Likewise, the transfer roller bearing 121 is urged toward the photosensitive drum 8 by a spring 125 as a second bearing urging member.

In the first embodiment, the transfer roller 9, the rotating shaft 110, the transfer roller bearing 111, and the transfer roller bearing 121 constitute a transfer unit.

As illustrated in FIG. 3A, the transfer roller bearing 111 includes a bearing portion 112 that is slidable with respect to the rotating shaft 110 of the transfer roller 9 and that supports the rotating shaft 110 allowing the rotation of the rotating shaft 110. The transfer roller bearing 111 also includes slide grooves 113 that allow the transfer roller 9 to slide substantially toward the center of the photosensitive drum 8. The slide grooves 113 are in engagement with guide ribs (not illustrated) in such a manner as to be linearly movable. The guide ribs extend substantially parallel to the direction toward the center of the photosensitive drum 8. The transfer roller 9 is thus pressed against the photosensitive drum 8 with an urging force exerted by the spring 115.

The transfer roller bearing 111 also includes a hook portion 114 on a side thereof substantially opposite the photosensitive drum 8. The hook portion 114 corresponds to a first engagement receiving portion. The hook portion 114 also corresponds to a first separating portion that separates one end of the transfer member from the image carrying member.

As illustrated in FIG. 3B, the transfer roller bearing 121 includes a bearing portion 122 that is slidable with respect to the rotating shaft 110 of the transfer roller 9 and that supports the rotating shaft 110 allowing the rotation of the rotating shaft 110. The transfer roller bearing 121 also includes slide grooves 123 that allow the transfer roller 9 to slide substantially toward the center of the photosensitive drum 8. The slide grooves 123 are in engagement with guide ribs (not illustrated) in such a manner as to be linearly movable. The guide ribs extend substantially parallel to the direction toward the center of the photosensitive drum 8. The transfer roller 9 is thus pressed against the photosensitive drum 8 with an urging force exerted by the spring 125.

The transfer roller bearing 121 also includes a hook portion 124 on a side thereof substantially opposite the photosensitive drum 8. The hook portion 124 corresponds to a second engagement receiving portion. The hook portion 124 also corresponds to a second separating portion that separates the other end of the transfer member from the image carrying member.

As illustrated in FIGS. 2A and 2B, the engaging unit includes the engaging member that is a long plate-like member extending in the axial direction and provided substantially across the transfer roller 9 from the photosensitive drum 8. The locking member 131 as the engaging member is slidable in the axial direction of the transfer roller 9. As illustrated in FIGS. 2A and 2B, the locking member 131 constantly receives an urging force acting in a direction of an arrow 153 and applied thereto by a separating spring 151 as an urging member.

FIG. 4A is a perspective view of the locking member 131 with two axial ends thereof illustrated in enlarged view. The locking member 131 includes a locking portion 132 as a first engaging portion at one end thereof corresponding to the transfer roller bearing 111, and a locking portion 133 as a second engaging portion at the other end thereof corresponding to the transfer roller bearing 121. As illustrated in FIG. 4B, the locking portion 132 is engageable with the hook portion 114 that faces the locking portion 132, and the locking portion 133 is engageable with the hook portion 124 that faces the locking portion 133. That is, the locking member 131 corresponds to an engaging member configured to engage with the hook portion 114 as the first separating portion and with the hook portion 124 as the second separating portion.

As illustrated in FIGS. 2A and 2B, the stopper member 141 is provided at the end of the locking member 131 that corresponds to the transfer roller bearing 121. FIG. 5A illustrates the stopper member 141. The stopper member 141 includes a gear portion 142 that allows the stopper member 141 to rotate with the aid of a precedent gear 152. The precedent gear 152 is a driving gear that is driven by a driving source (not illustrated) provided in the main body. The gear portion 142 has a partially toothless shape.

The stopper member 141 also includes a stopper portion 143 as a contact receiving portion that is configured to come into contact with a contact portion 134 (illustrated in FIG. 5B) of the locking member 131. The stopper member 141 corresponds to a regulating member that regulates the position of the locking member 131 in the axial direction by coming into contact with the locking member 131 that is urged by the separating spring 151. In the first embodiment, the stopper portion 143 has a substantially semicircular shape, and the center of rotation of the gear portion 142 coincides with the center of the semicircular shape of the stopper portion 143.

FIG. 5B is an enlarged view illustrating the end of the locking member 131 that corresponds to the transfer roller bearing 121. The locking member 131 includes the contact portion 134 configured to come into contact with the stopper portion 143 of the stopper member 141. The contact portion 134 has a groove 135 having a substantially semicircular shape. The locking member 131 also includes a sloping portion 136 that is continuous with the contact portion 134.

Operation of Separating Transfer Roller from Photosensitive Drum

Figure 6A:
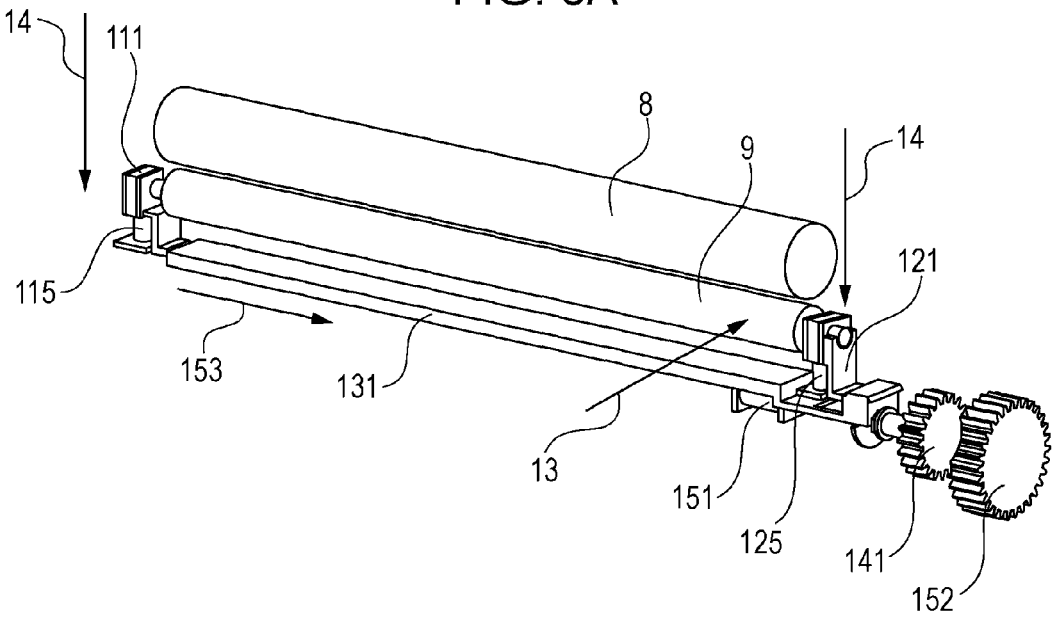
FIG. 6A is another schematic perspective view of the separating mechanism according to the first embodiment.
Figure 6B:
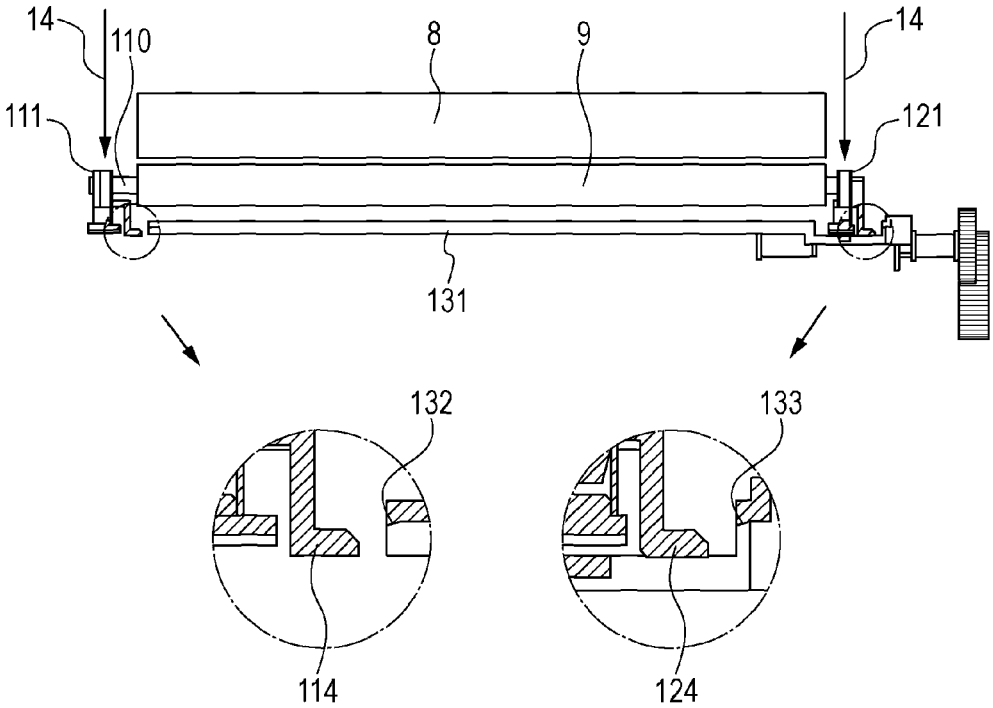
FIG. 6B is another schematic side view of the separating mechanism according to the first embodiment.
Figure 7A:
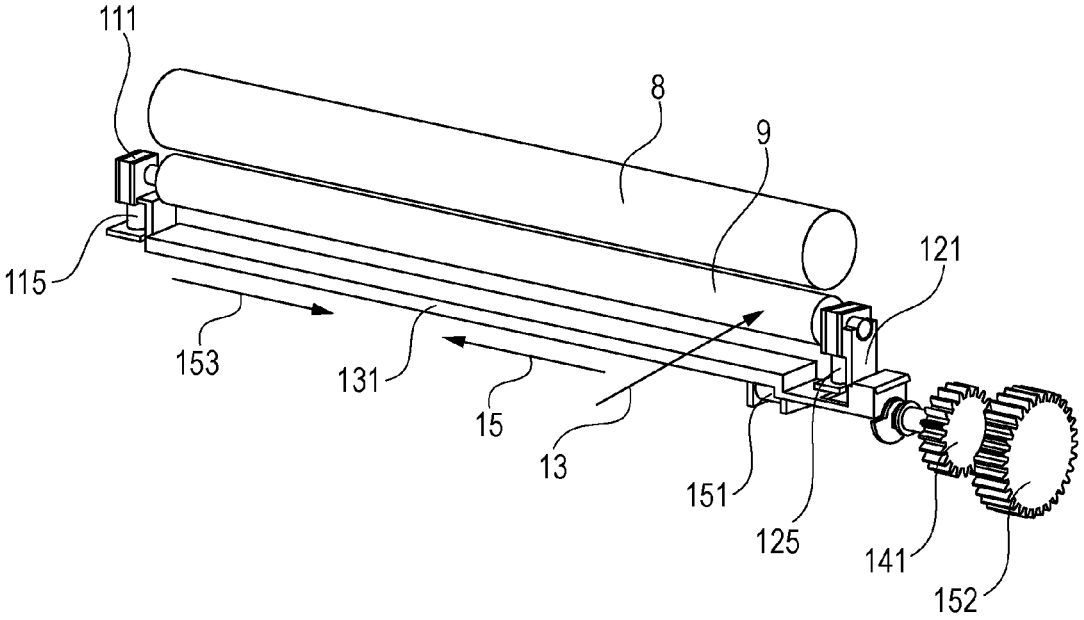
FIG. 7A is yet another schematic perspective view of the separating mechanism according to the first embodiment.
Figure 7B:
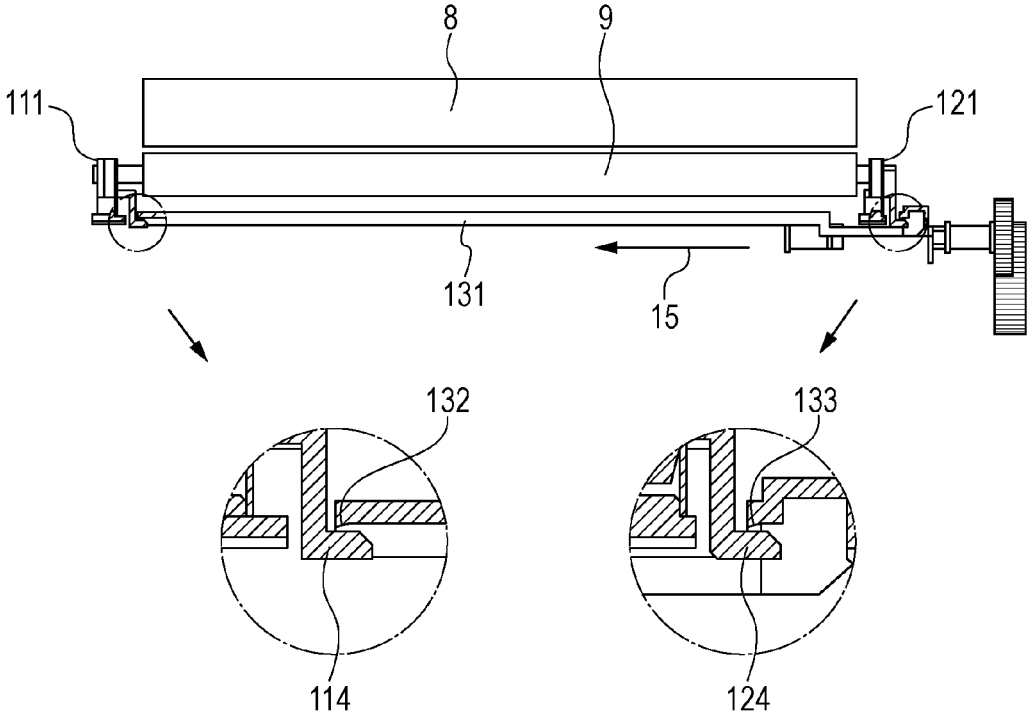
FIG. 7B is yet another schematic side view of the separating mechanism according to the first embodiment.
Figure 8A:
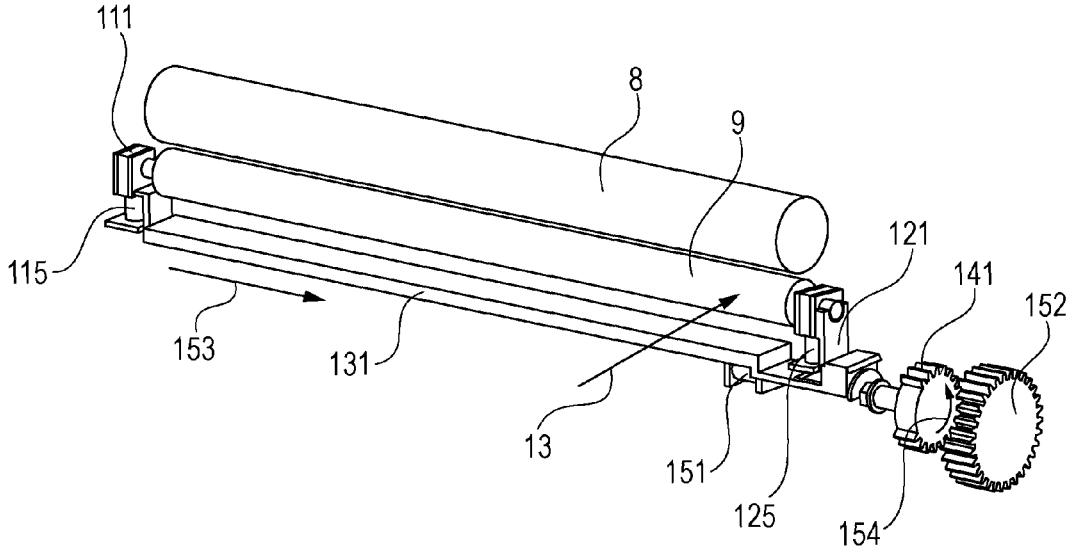
FIG. 8A is yet another schematic perspective view of the separating mechanism according to the first embodiment.
Figure 8B:
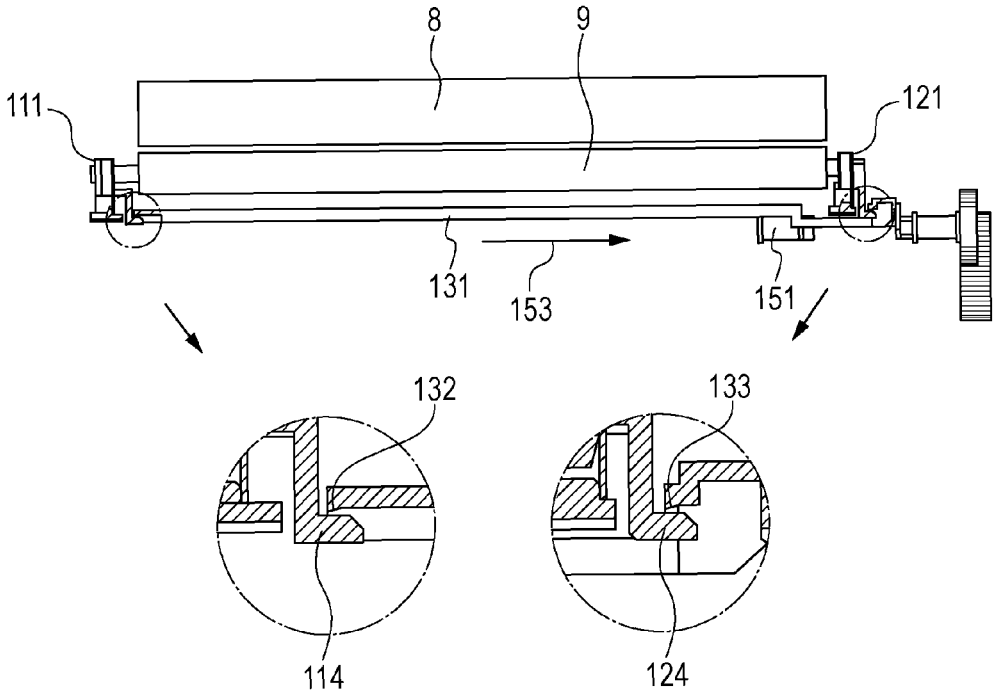
FIG. 8B is yet another schematic side view of the separating mechanism according to the first embodiment.

An operation of separating the transfer roller 9 from the photosensitive drum 8 will now be described with reference to FIGS. 6A to 8B. FIGS. 6A, 7A, and 8A are perspective views each illustrating the transfer roller 9, the photosensitive drum 8, and a separating mechanism. FIGS. 6B, 7B, and 8B are side views each illustrating the transfer roller 9, the photosensitive drum 8, and the separating mechanism, with portions thereof illustrated in enlarged view.

To separate the transfer roller 9 from the photosensitive drum 8, the transfer roller 9 is first pressed down by at least a certain length in a direction of arrows 14 (a direction opposite to the direction of urging by the springs 115 and 125) as illustrated in FIGS. 6A and 6B. In this step, the rotating shaft 110 of the transfer roller 9 is in engagement with the bearing portion 112 of the transfer roller bearing 111 and the bearing portion 122 of the transfer roller bearing 121. Therefore, as illustrated in FIGS. 6A and 6B, the transfer roller bearing 111 and the transfer roller bearing 121 also move in the direction of the arrows 14, i.e., in a direction away from the photosensitive drum 8.

The length by which the transfer roller 9 is pressed down is set such that, as illustrated in FIG. 6B, the hook portion 114 of the transfer roller bearing 111 and the hook portion 124 of the transfer roller bearing 121 are positioned below the locking portion 132 and the locking portion 133, respectively.

Subsequently, as illustrated in FIG. 7A, the locking member 131 is moved in the axial direction and away from the stopper member 141 (in a direction of an arrow 15). The direction of the arrow 15 is opposite to the direction of urging (the direction of the arrow 153) by the separating spring 151. As illustrated in the enlarged views in FIG. 7B, when the locking member 131 is moved in the direction of the arrow 15, the hook portion 114 and the hook portion 124 engage with the locking portion 132 and the locking portion 133, respectively.

The locking member 131 receives the urging force exerted in the direction of the arrow 153 by the separating spring 151. However, since the contact portion 134 and the stopper portion 143 are in contact with each other, the locking member 131 does not slide in the direction of the arrow 153. Hence, the locking portion 132 and the locking portion 133 do not move in such a direction as to be disengaged from the hook portion 114 and the hook portion 124, respectively. Therefore, the transfer roller 9 is positioned at a certain distance from the photosensitive drum 8.

As illustrated in FIG. 8A, while the transfer roller 9 and the photosensitive drum 8 are kept separated from each other, the stopper member 141 is rotated in a direction of an arrow 154, whereby the precedent gear 152 and the gear portion 142 are made to mesh with each other. The phase of the stopper member 141 in this step is defined as a first phase. As illustrated in FIG. 8B, even if the stopper member 141 is rotated, the locking member 131 is maintained to be in engagement with the transfer roller bearing 111 and the transfer roller bearing 121. The angle of rotation of the stopper member 141 needs to be larger than or equal to an angle at which the contact portion 134 and the stopper portion 143 come into contact with each other. In the first embodiment, the angle of rotation of the stopper member 141 is approximately 180 degrees. FIGS. 8A and 8B illustrate a state where the stopper member 141 has been rotated in the direction of the arrow 154 by approximately 180 degrees from the state illustrated in FIGS. 6A and 6B. As illustrated in FIGS. 8A and 8B, in the state where the transfer roller 9 is separated from the photosensitive drum 8, the arc of the stopper portion 143 having a substantially semicircular shape is positioned on the upper side.

Operation of Canceling Separation of Transfer Roller from Photosensitive Drum

Figure 9A:
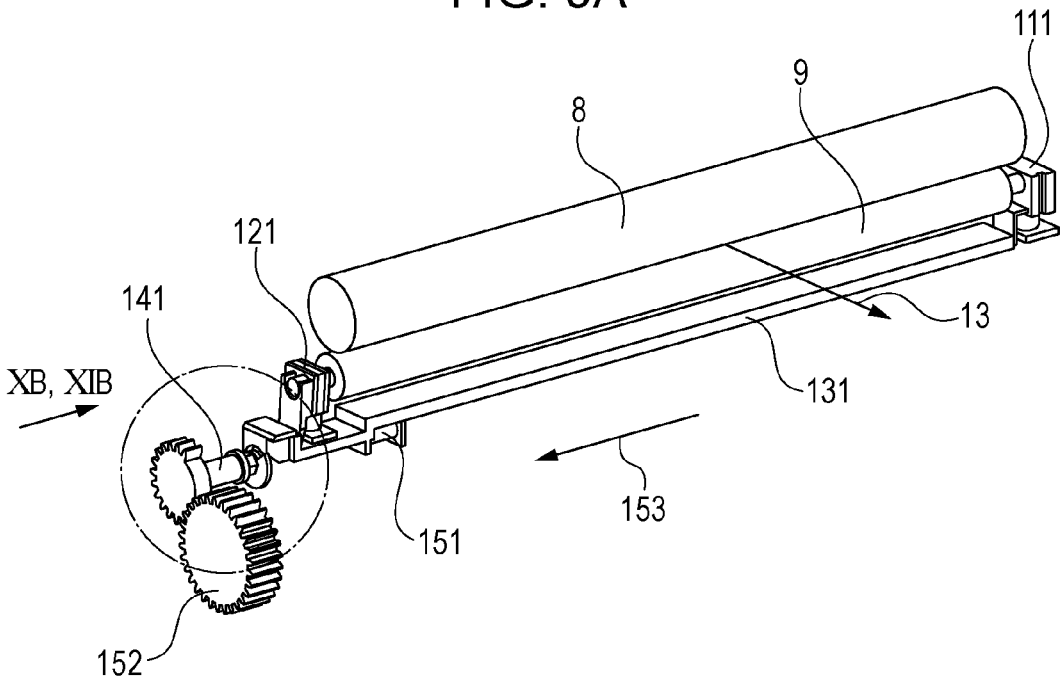
FIG. 9A is a perspective view illustrating the positional relationship between the regulating member and the engaging member according to the first embodiment.
Figure 9B:
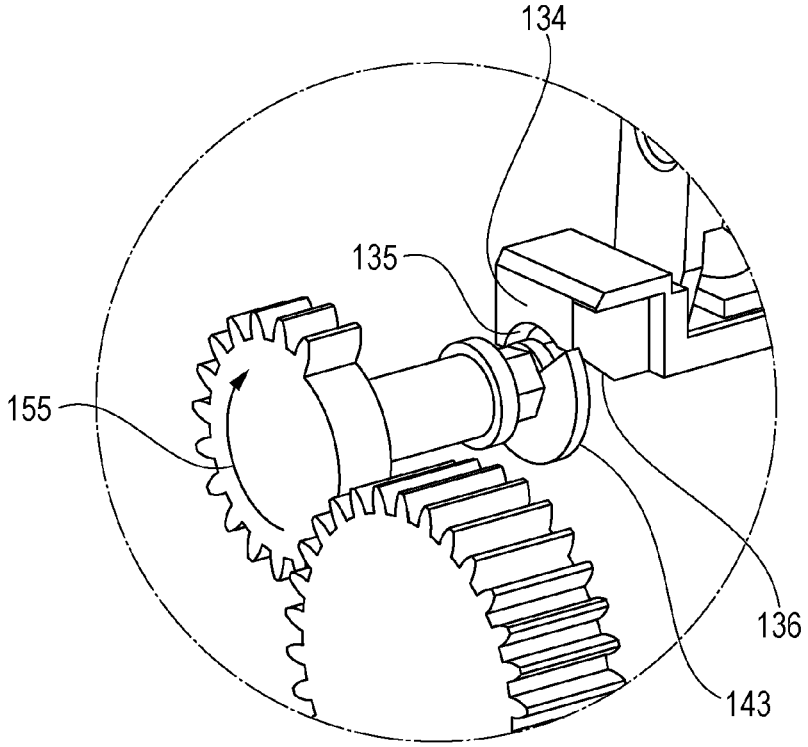
FIG. 9B is an enlarged view of an encircled part of FIG. 9A and illustrates the positional relationship between the regulating member and the engaging member according to the first embodiment.

An operation (separation canceling operation) of changing the position of the transfer roller 9 having been separated from the photosensitive drum 8 to a position where the transfer roller 9 comes into pressure contact with the photosensitive drum 8 will now be described. FIGS. 8A and 8B are diagrams seen from the upstream side in the direction of conveyance of the recording material S (the direction of the arrow 13). FIGS. 9A and 9B are perspective views seen from the downstream side in the direction of conveyance of the recording material S (the direction of the arrow 13).

To cancel the state where the transfer roller 9 is separated from the photosensitive drum 8, the precedent gear 152, which corresponds to a transmission device, is first rotated with a driving force applied thereto from the main body. Consequently, as illustrated in FIGS. 9A and 9B, the stopper member 141 is rotated in a direction of an arrow 155 illustrated in FIG. 9B. When the stopper member 141 is rotated, the stopper member 141 becomes out of contact with the contact portion 134. The contact portion 134 has the groove 135 having a substantially semicircular shape. The stopper portion 143 also has a substantially semicircular shape. Therefore, when the stopper member 141 is rotated by a certain angle, the stopper portion 143 is oriented in such a phase as to be fitted into the groove 135 having a semicircular shape (see FIG. 9B). In this step, the locking member 131 that is urged in the direction of the arrow 153 by the separating spring 151 moves in the direction of the arrow 153.

Figure 10A:
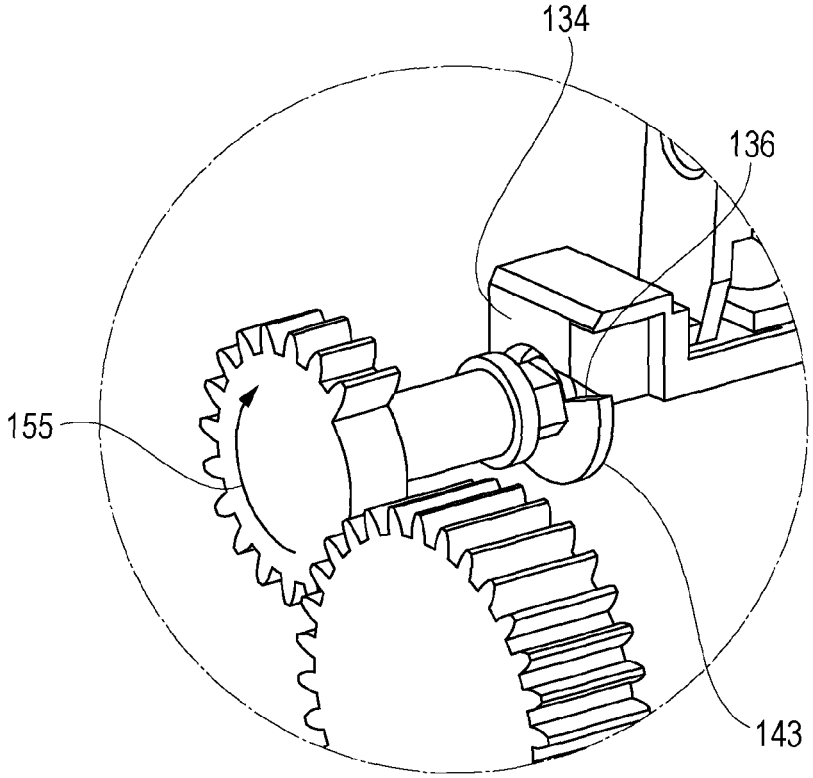
FIG. 10A is another perspective view illustrating the positional relationship between the regulating member and the engaging member according to the first embodiment.
Figure 10B:
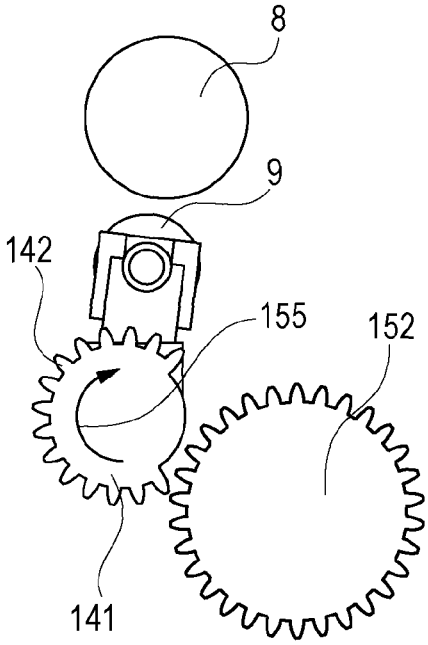
FIG. 10B is a sectional view illustrating the state illustrated in FIG. 10A that is seen in an axial direction.

FIG. 10A is an enlarged view of the stopper member 141 corresponding to FIG. 9B. FIG. 10B is a sectional view of the state illustrated in FIG. 10A that is seen in a direction of an arrow XB illustrated in FIG. 9A. As illustrated in FIG. 10A, when the stopper member 141 is rotated, the stopper portion 143 having a substantially semicircular shape comes into contact with the sloping portion 136 of the locking member 131. In this state, the locking member 131 slides in the direction of the arrow 153. The gear portion 142 of the stopper member 141 is a partially toothless gear. Therefore, when the stopper member 141 is rotated by a certain angle as illustrated in FIG. 10B, the rotation of the stopper member 141 stops at a toothless portion of the gear portion 142.

As illustrated in FIG. 10B, in the first embodiment, the angle at which the transmission of the driving force between the gear portion 142 and the precedent gear 152 is disabled at the toothless portion is set to an angle at which the stopper portion 143 is positioned substantially at the center of the sloping portion 136.

After the stopper portion 143 and the sloping portion 136 are positioned as illustrated in FIG. 10A, the locking member 131 further moves in the direction of the arrow 153 with the urging force exerted by the separating spring 151. In this step, the sloping portion 136 functions as a cam and rotates the stopper portion 143. That is, the operation of the sloping portion 136 as a cam causes the stopper member 141 to rotate in the direction of the arrow 155 by a certain angle from the state where the transmission of the driving force from the main body is disabled.

Figure 11A:
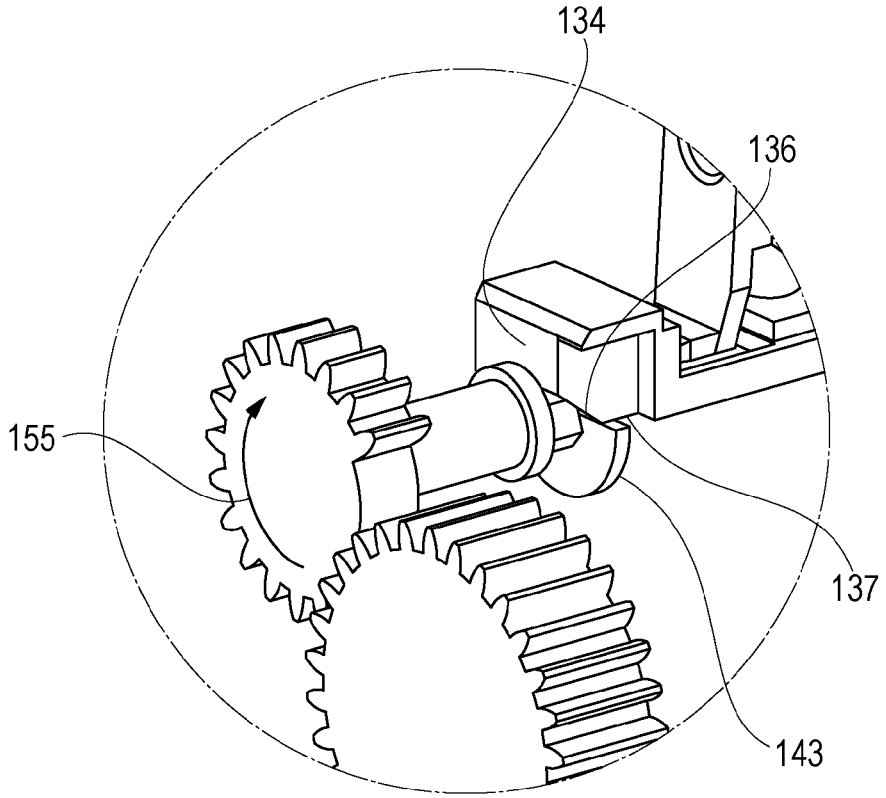
FIG. 11A is yet another perspective view illustrating the positional relationship between the regulating member and the engaging member according to the first embodiment.
Figure 11B:
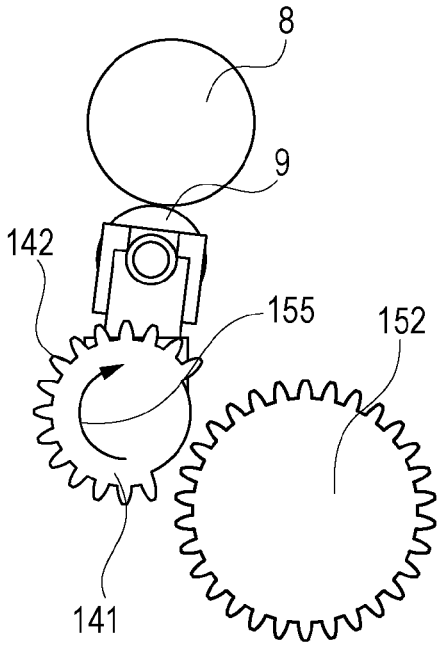
FIG. 11B is a sectional view illustrating the state illustrated in FIG. 11A that is seen in the axial direction.

FIG. 11A is an enlarged view illustrating a state where the stopper member 141 has been rotated from the state illustrated in FIGS. 10A and 10B and the sliding of the locking member 131 has ended. FIG. 11B is a sectional view of the state illustrated in FIG. 11A that is seen in the direction of an arrow XIB illustrated in FIG. 9A.

In the state illustrated in FIGS. 11A and 11B according to the first embodiment, a certain gap is interposed between the gear portion 142 and the teeth of the precedent gear 152 so that the gear portion 142 is not in contact with the teeth of the precedent gear 152. The locking member 131 includes a preventing portion 137 adjoining the sloping portion 136. In the state illustrated in FIG. 11A, the rotation of the stopper member 141 is prevented by the preventing portion 137. Furthermore, since the locking member 131 moves in the direction of the arrow 153, the locking member 131 moves away from the hook portion 114 and the hook portion 124. The phase of the stopper member 141 in this step is defined as a second phase.

The state illustrated in FIGS. 11A and 11B corresponds to the state illustrated in FIGS. 2A and 2B, in which the transfer roller bearing 111 and the transfer roller bearing 121 that have been locked by the locking member 131 are released. Hence, the transfer roller bearing 111 and the transfer roller bearing 121 that are urged with the urging forces exerted by the spring 115 and the spring 125 bring the transfer roller 9 into pressure contact with the photosensitive drum 8.

The operation of canceling the separation of the transfer roller 9 from the photosensitive drum 8 is performed only when the stopper member 141 is rotated for the first time immediately after the power supply of the image forming apparatus 1 is turned on for the first time by the user. In a case where the image forming apparatus 1 is transported with the process cartridge 6 attached to the main body, the transfer roller 9 can be automatically brought into pressure contact with the photosensitive drum 8 by the separation canceling operation performed by the separating mechanism. In such a case, the locking member 131 does not need to be removed from the main body. Accordingly, there is no need to perform a special operation so as to automatically bring the transfer roller 9 into contact with the photosensitive drum 8. For example, there is no need to dispose wrapping materials and the locking member 131.

After the separation canceling operation, the gear portion 142 and the precedent gear 152 are disengaged from each other at the toothless portion. Furthermore, the hook portion 114 of the transfer roller bearing 111 and the hook portion 124 of the transfer roller bearing 121 are out of contact with the locking member 131. The hook portion 114 and the hook portion 124 are not locked by the locking member 131 at least in terms of the urging forces of the spring 115 and the spring 125 and in the axial direction. That is, in the state where the transfer roller 9 is in pressure contact with the photosensitive drum 8, both the locking member 131 and the stopper member 141 do not apply any loads to the transfer roller 9.

Furthermore, since the locking member 131 is movable in the axial direction, a driving device (the precedent gear 152) that transmits the driving force to the gear portion 142 of the stopper member 141 only needs to be provided at the other end of the locking member 131. Thus, the mechanism of transmitting the driving force from the driving source to the locking member 131 is simplified.

Hence, the transfer roller 9 can be brought into pressure contact with the photosensitive drum 8 with no influence of the locking member 131 and the stopper member 141 upon the state of pressure contact and upon the rotation of the transfer roller 9.

Figure 12A:
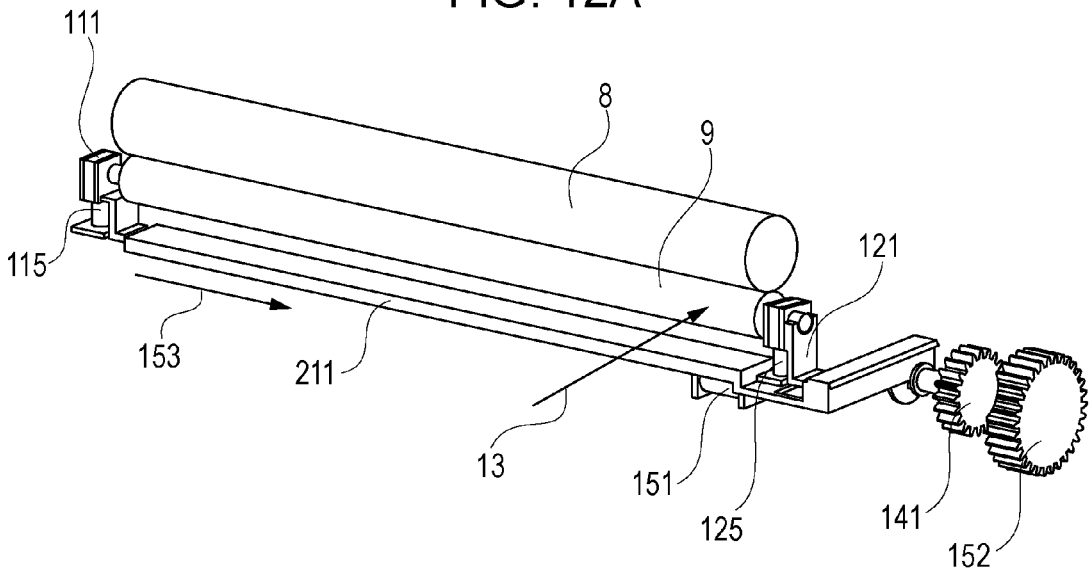
FIG. 12A is a schematic perspective view of another separating mechanism according to the first embodiment.
Figure 12B:
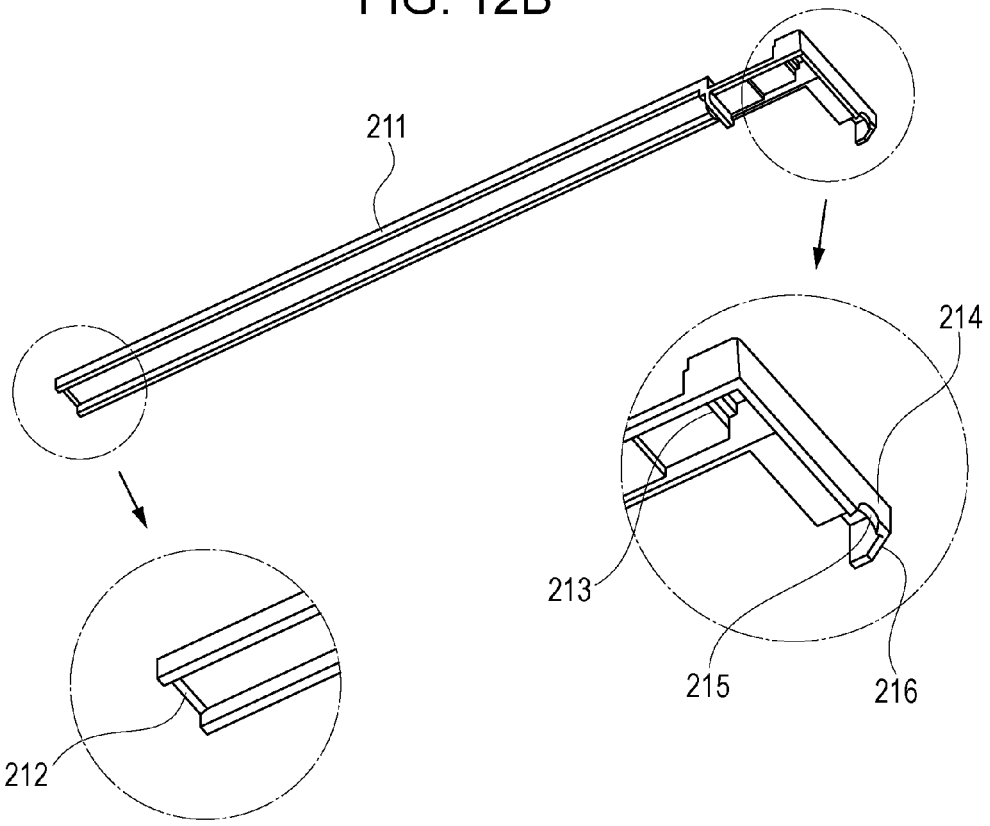
FIG. 12B illustrates another engaging member according to the first embodiment.

The contact portion 134 and the locking portion 132 of the locking member 131 may be staggered with respect to each other. FIG. 12A schematically illustrates a locking member 211. FIG. 12B also illustrates the locking member 211 with portions thereof illustrated in enlarged view.

The locking member 211 is provided substantially across the transfer roller 9 from the photosensitive drum 8. The locking member 211 is slidable in the axial direction of the transfer roller 9.

The locking member 211 includes a locking portion 212 configured to engage with the hook portion 114 of the transfer roller bearing 111, and a locking portion 213 configured to engage with the hook portion 124 of the transfer roller bearing 121. The locking portion 212 and the locking portion 213 are positioned near and immediately below the transfer roller 9. The locking member 211 also includes a contact portion 214 configured to come into contact with the stopper member 141. According to such a modification of the first embodiment, the contact portion 214 has a groove 215 having a substantially semicircular shape. Furthermore, the locking member 211 includes a sloping portion 216 that is continuous with the contact portion 214.

The contact portion 214 of the locking member 211 is staggered with respect to the locking portion 212. In such a configuration in which the contact portion 214 and the locking portion 212 are staggered with respect to each other, the separating operation and the separation canceling operation are performable even if the precedent gear 152 that transmits the driving force from the main body is staggered with respect to the locking portion 212.

Second Embodiment

The first embodiment concerns a case where the separating mechanism includes the locking member 131 and the stopper member 141, and the driving force is directly transmitted to the stopper member 141 from the precedent gear 152 provided on the main body. In contrast, a second embodiment concerns a case where the separating mechanism includes a locking member 311, a stopper member 321, and a separating gear 331 including a lever 333. The second embodiment is characterized in that the driving force is transmitted from the precedent gear 152 to the stopper member 321 via the separating gear 331. Other elements are the same as those included in the image forming apparatus 1 according to the first embodiment and are therefore denoted by the same reference numerals used in the first embodiment.

Mechanism of Separating Transfer Roller from Photosensitive Drum

Figure 13A:
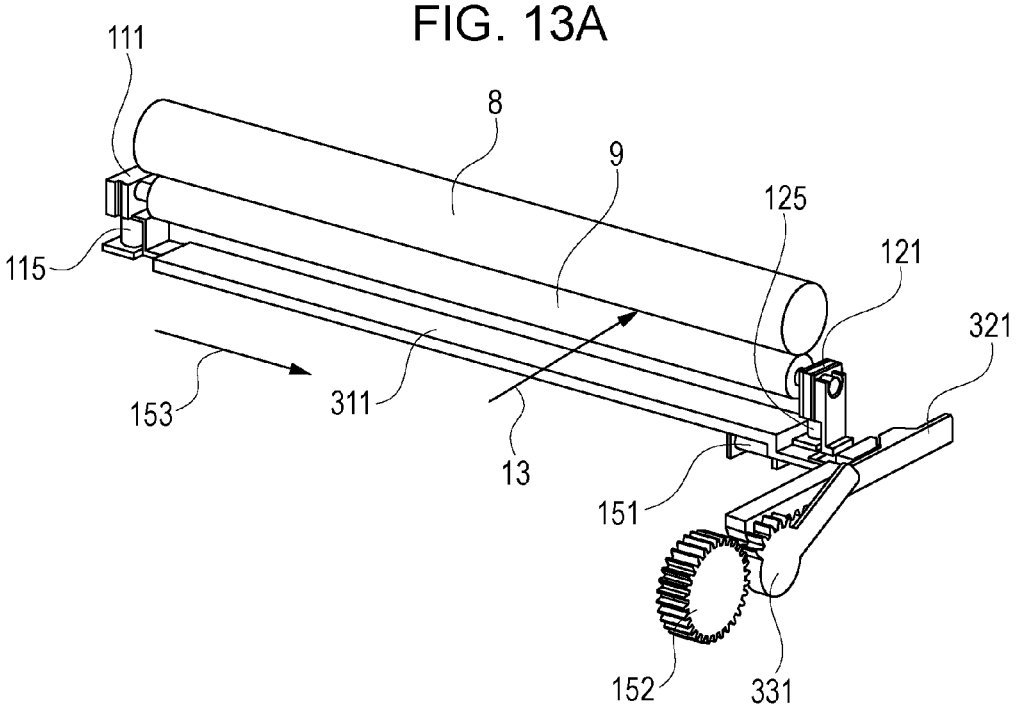
FIG. 13A is a schematic perspective view of a separating mechanism according to a second embodiment.
Figure 13B:
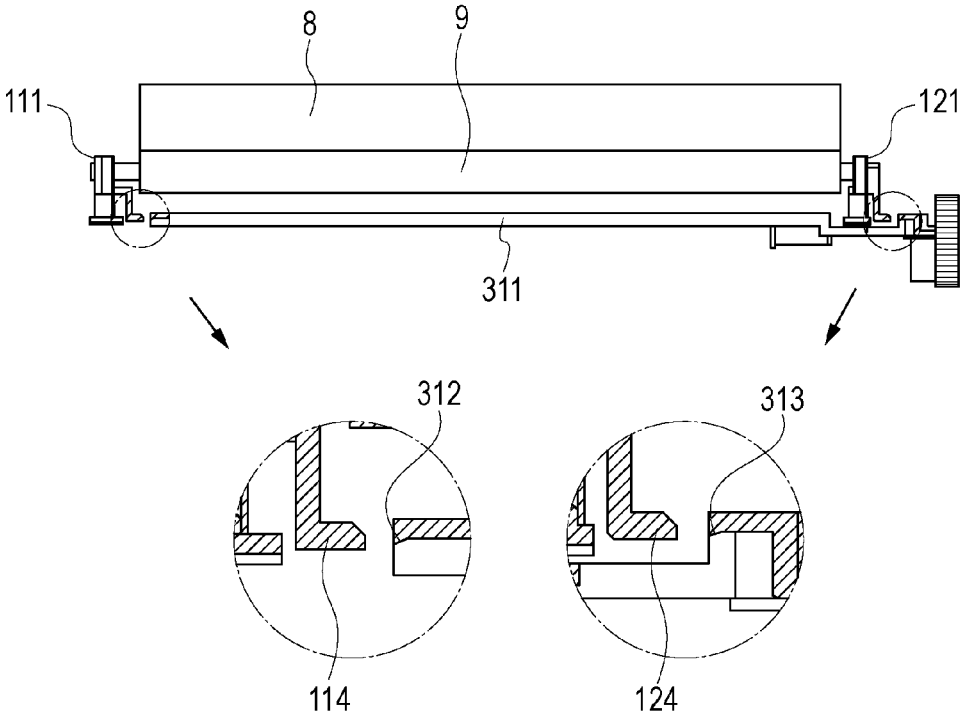
FIG. 13B is a schematic side view of the separating mechanism according to the second embodiment.
Figure 14:
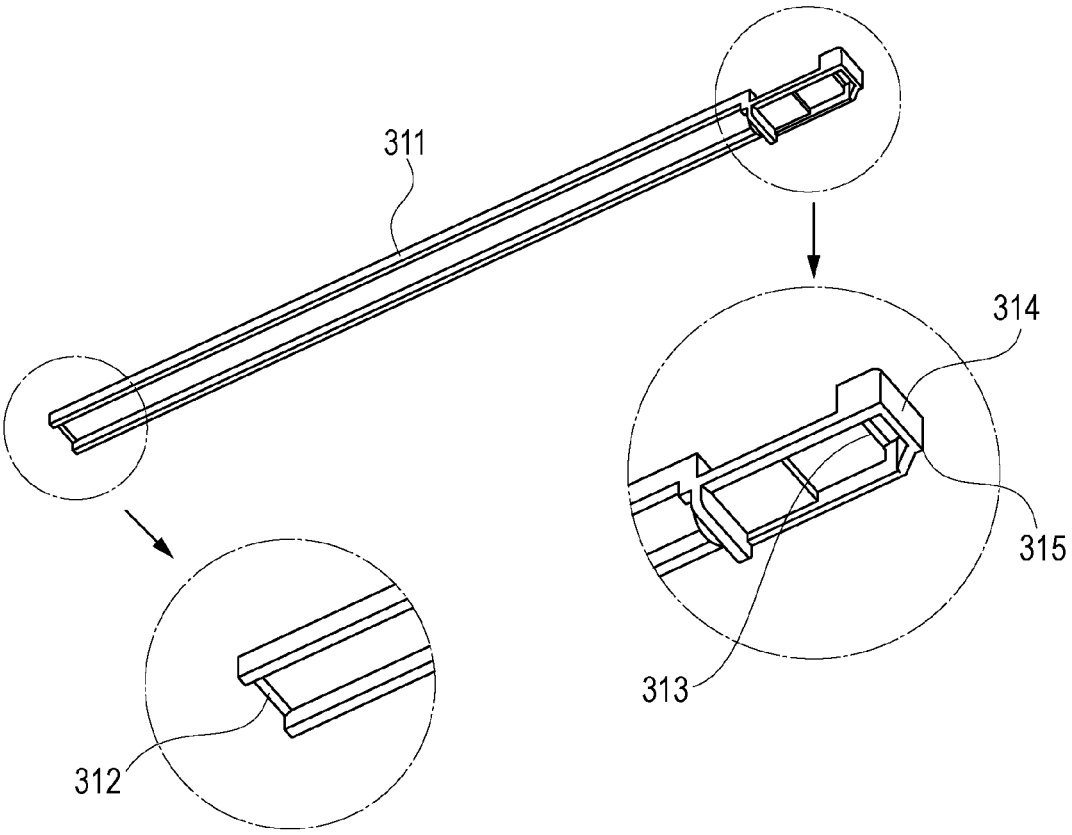
FIG. 14 illustrates an engaging member according to the second embodiment.
Figure 15A:
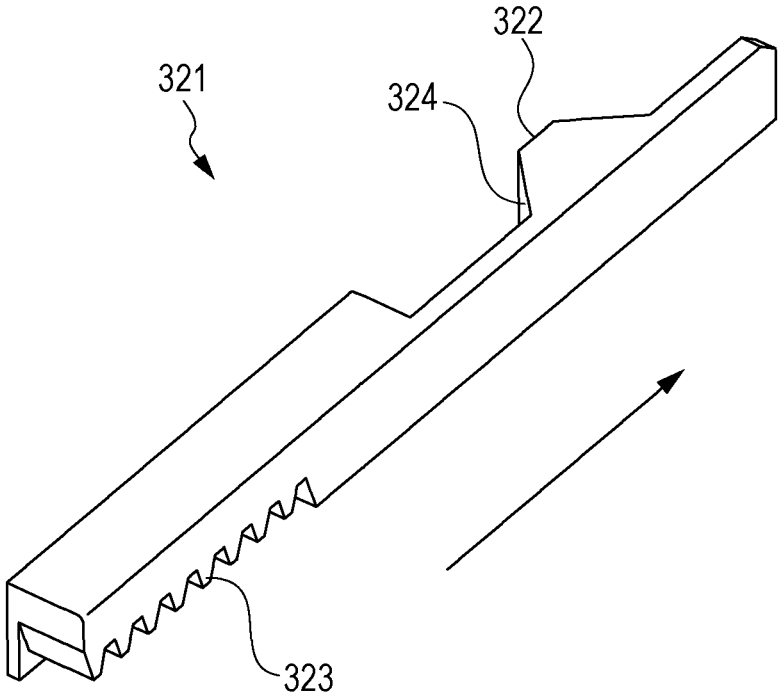
FIG. 15A illustrates the entirety of a regulating member according to the second embodiment.
Figure 15B:
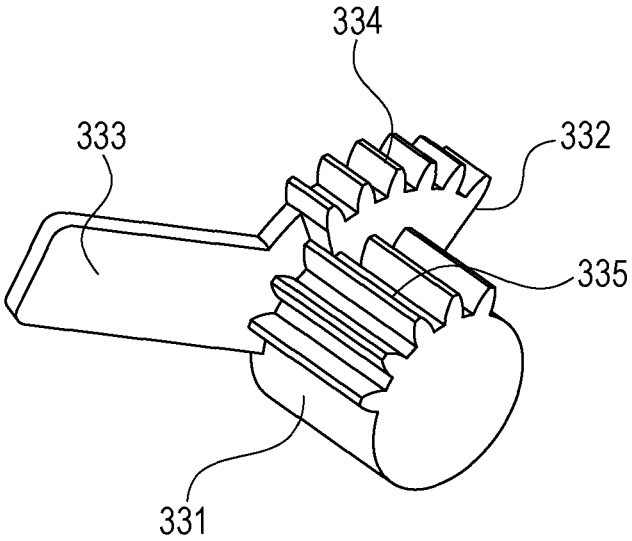
FIG. 15B illustrates a separating gear according to the second embodiment.

The separating mechanism according to the second embodiment that separates the transfer roller 9 from the photosensitive drum 8 will now be described. FIG. 13A is a schematic perspective view illustrating the entirety of the separating mechanism according to the second embodiment, with the transfer roller 9 being in pressure contact with the photosensitive drum 8. FIG. 13B is a schematic side view illustrating the entirety of the separating mechanism according to the second embodiment. FIG. 14 illustrates the entirety of the locking member 311 with portions thereof illustrated in enlarged view. FIG. 15A illustrates the stopper member 321. FIG. 15B illustrates the separating gear 331.

As illustrated in FIGS. 13A and 13B, the locking member 311 is provided substantially across the transfer roller 9 from the photosensitive drum 8. The locking member 311 is slidable in the axial direction of the transfer roller 9. As illustrated in FIGS. 13B and 14, the locking member 311 includes a locking portion 312 configured to engage with the hook portion 114 of the transfer roller bearing 111, and a locking portion 313 configured to engage with the hook portion 124 of the transfer roller bearing 121. The locking member 311 also includes a contact portion 314 configured to come into contact with the stopper member 321, and a slide portion 315 that is continuous with the contact portion 314.

As illustrated in FIG. 15A, the stopper member 321 includes a stopper portion 322, a rack portion 323, and a sloping portion 324 that is continuous with the stopper portion 322. The stopper portion 322 is configured to come into contact with the locking member 311. The stopper member 321 receives the driving force at the rack portion 323 and is slidable in a direction of an arrow illustrated in FIG. 15A (a direction that is orthogonal to the axial direction, i.e., a direction parallel to the direction of conveyance of the recording material S).

The stopper member 321 includes the sloping portion 324 that is continuous with the stopper portion 322. The sloping portion 324 and the slide portion 315 of the locking member 311 function by coming into contact with each other.

As illustrated in FIG. 15B, the separating gear 331 transmits the driving force from the main body to the stopper member 321 via the rack portion 323. The separating gear 331 includes a gear portion 335 configured to engage with the rack portion 323, and a gear portion 334 configured to engage with the precedent gear 152. The gear portion 334 includes a toothless portion 332. The separating gear 331 includes the lever 333 that allows the separating gear 331 to rotate with an external force. To perform the separating operation, the lever 333 is rotated manually or by using a tool.

Operation of Separating Transfer Roller from Photosensitive Drum

Figure 16A:
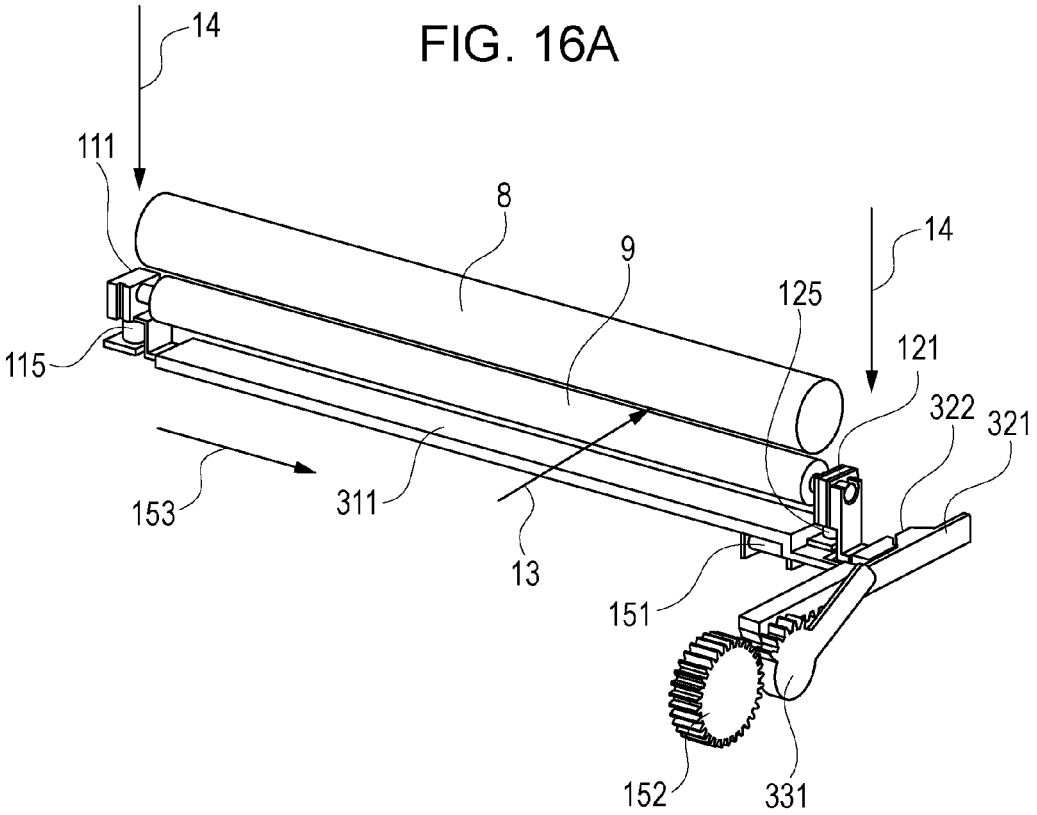
FIG. 16A is another schematic perspective view of the separating mechanism according to the second embodiment.
Figure 16B:
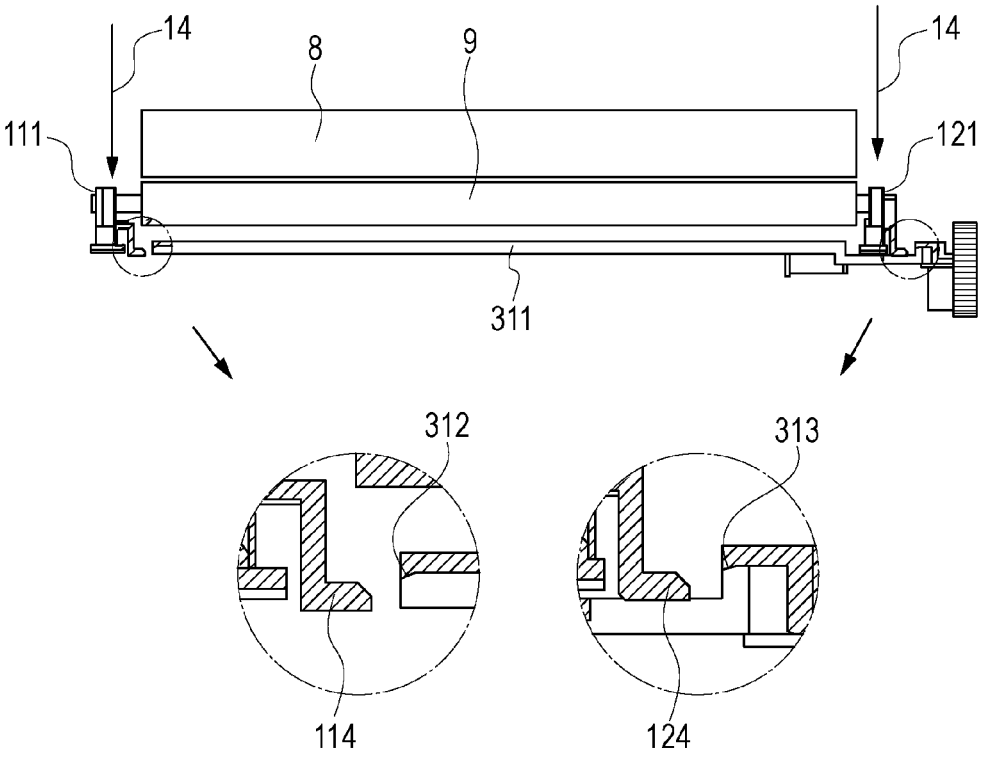
FIG. 16B is another schematic side view of the separating mechanism according to the second embodiment.
Figure 17A:
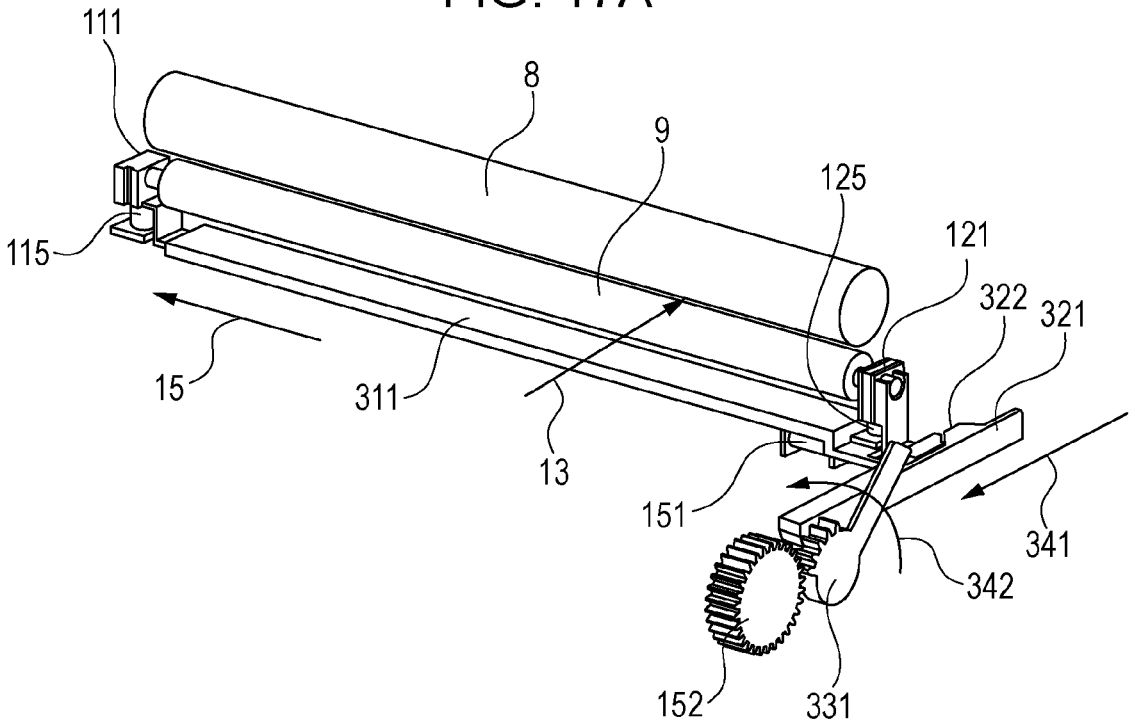
FIG. 17A is yet another schematic perspective view of the separating mechanism according to the second embodiment.
Figure 17B:
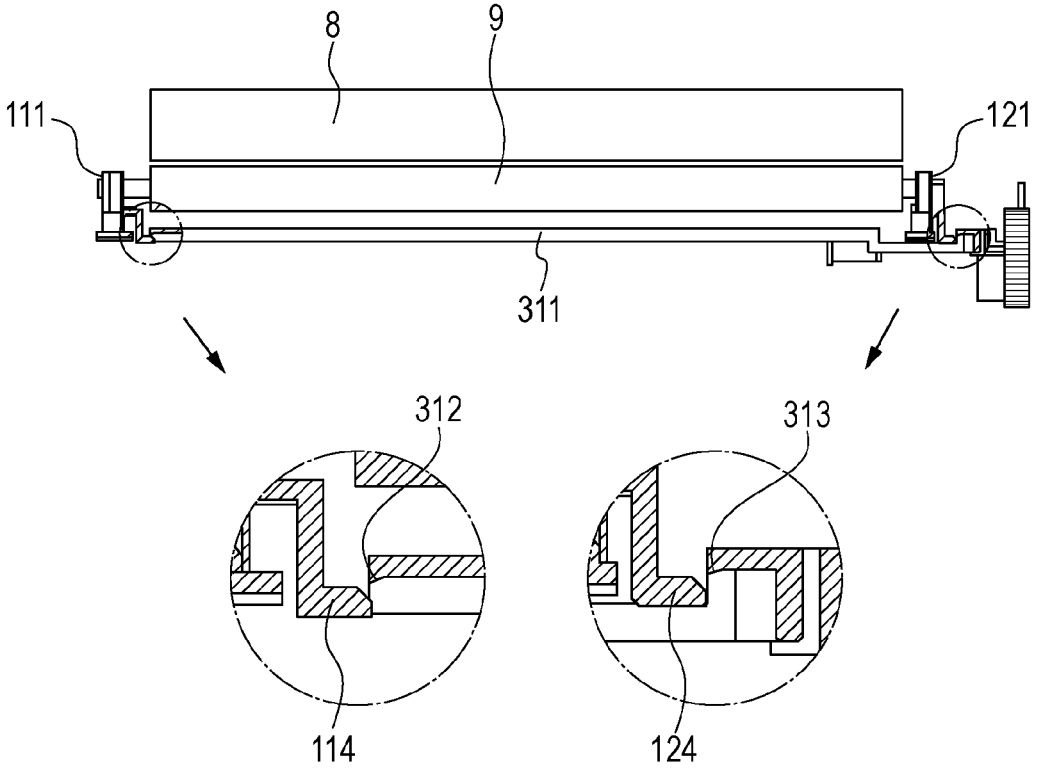
FIG. 17B is yet another schematic side view of the separating mechanism according to the second embodiment.
Figure 18:
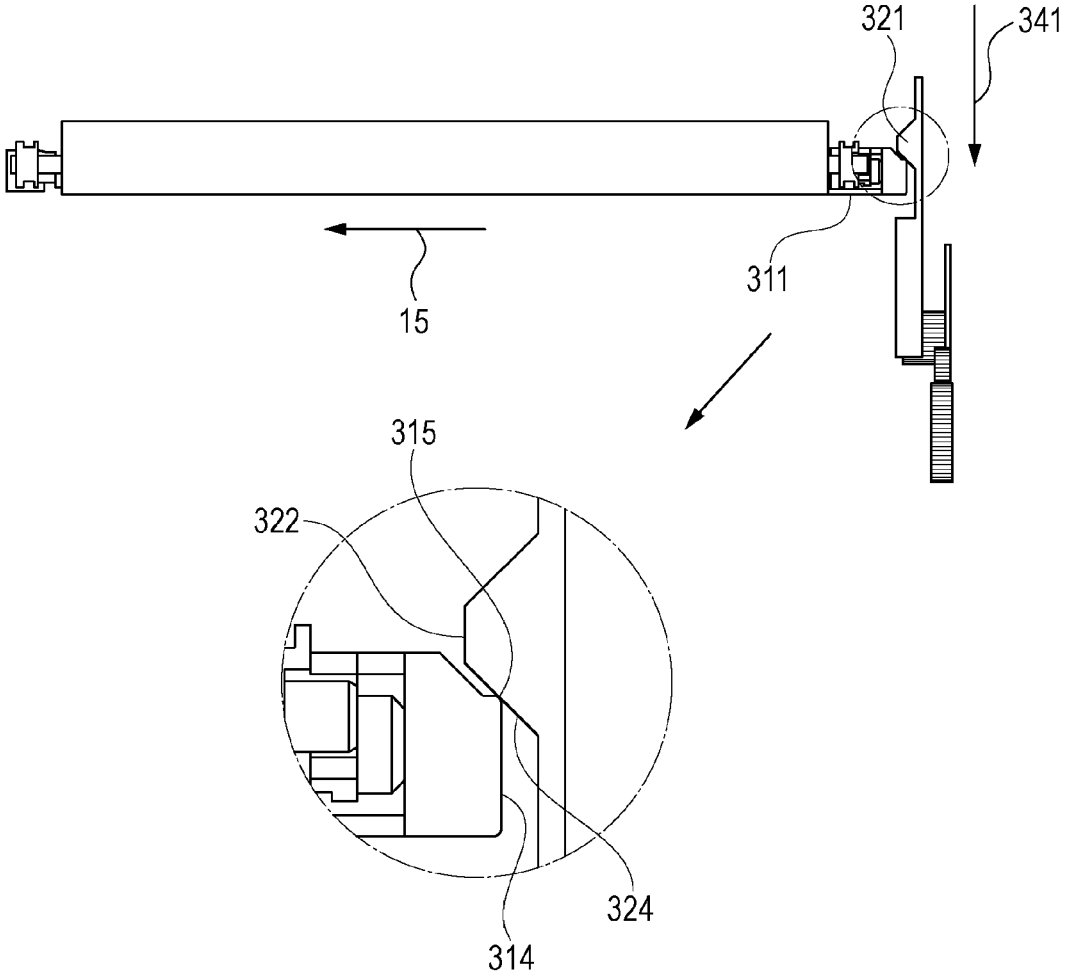
FIG. 18 is a top view illustrating the relationship between the engaging member and the regulating member according to the second embodiment, with a portion where the engaging member and the regulating member are in contact with each other illustrated in enlarged view.
Figure 19A:
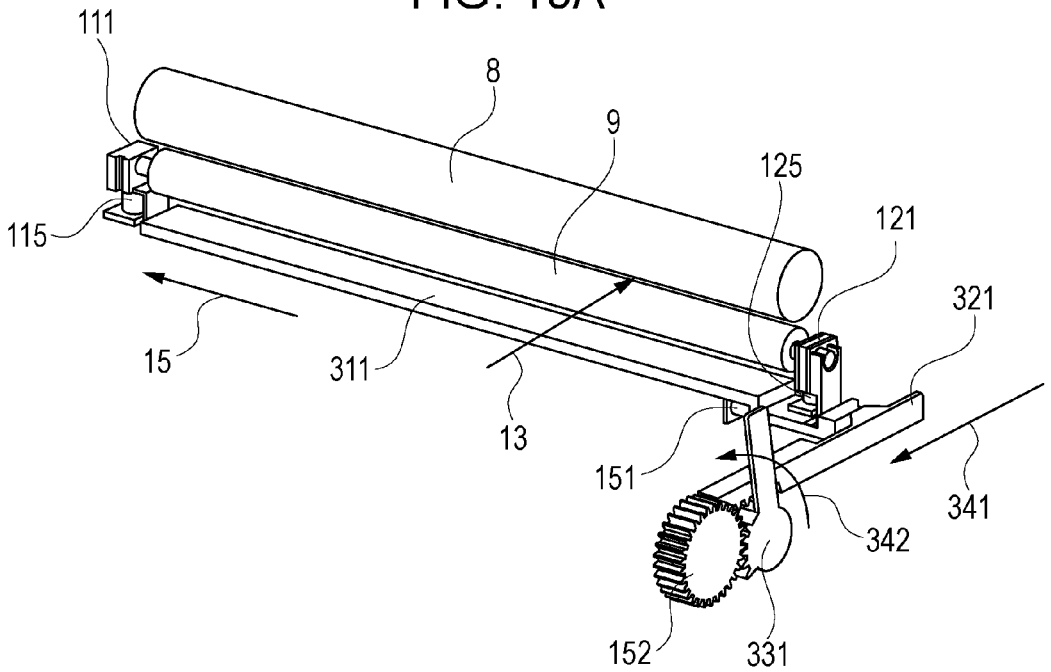
FIG. 19A is yet another schematic perspective view of the separating mechanism according to the second embodiment.
Figure 19B:
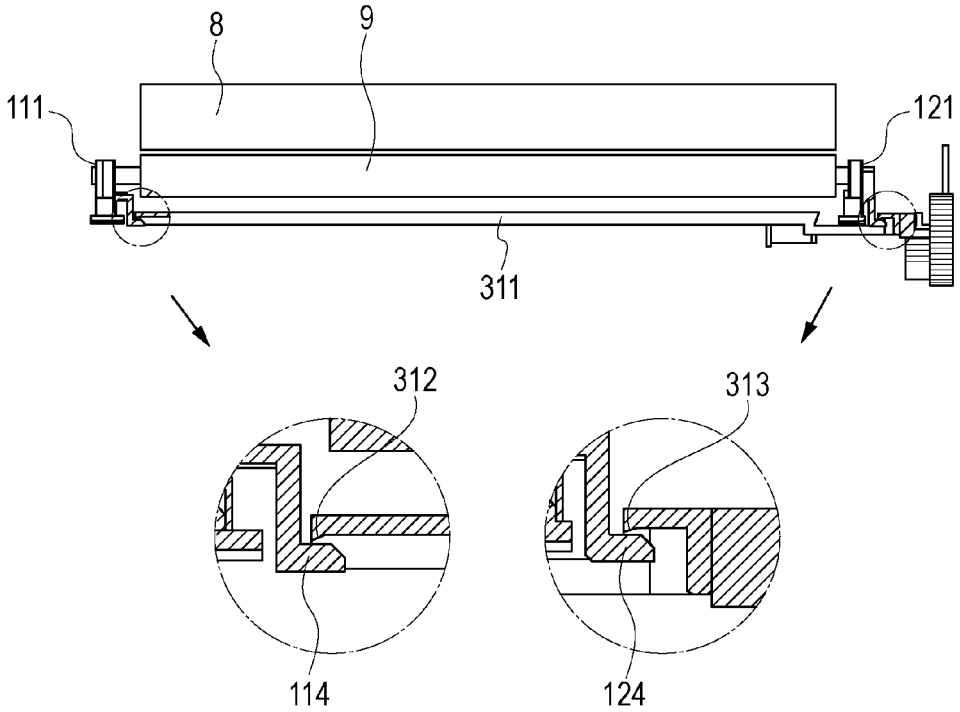
FIG. 19B is yet another schematic side view of the separating mechanism according to the second embodiment.
Figure 20:
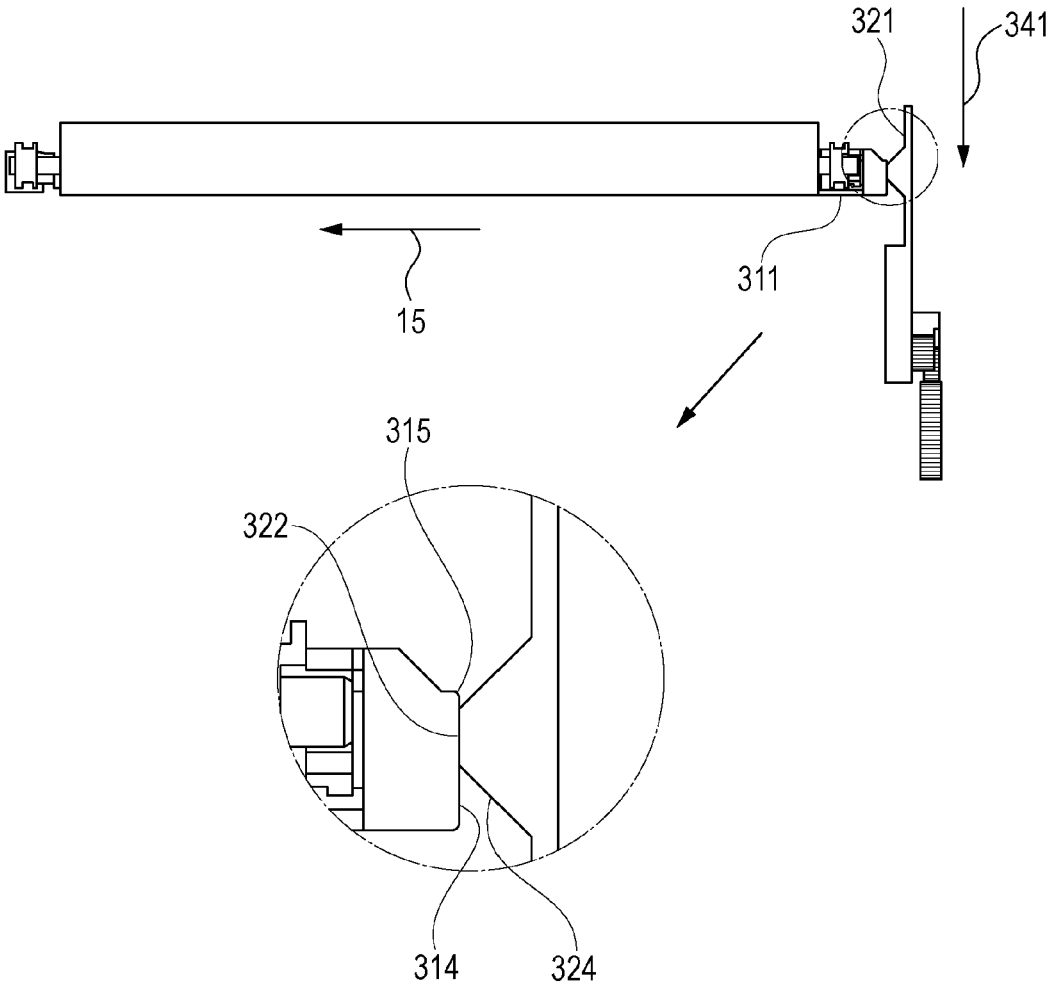
FIG. 20 is another top view illustrating the relationship between the engaging member and the regulating member according to the second embodiment, with the portion where the engaging member and the regulating member are in contact with each other illustrated in enlarged view.

An operation of moving the transfer roller 9 that has been in contact with the photosensitive drum 8 to a position away from the photosensitive drum 8 will now be described with reference to FIGS. 16A to 20. FIGS. 16A, 17A, and 19A are perspective views illustrating the operation of the separating mechanism. FIGS. 16B, 17B, and 19B are side views illustrating the operation of the separating mechanism. FIGS. 18 and 20 are top views illustrating the relationship between the locking member 311 and the stopper member 321, with a portion where the locking member 311 and the stopper member 321 are in contact with each other illustrated in enlarged view.

The transfer roller 9 that is in contact with the photosensitive drum 8 as illustrated in FIGS. 13A and 13B is pressed down as illustrated in FIG. 16A by at least a certain length in the direction of the arrows 14, i.e., in a direction away from the photosensitive drum 8. In this step, the rotating shaft 110 of the transfer roller 9 is in engagement with the bearing portion 112 of the transfer roller bearing 111 and with the bearing portion 122 of the transfer roller bearing 121. Therefore, the transfer roller bearing 111 and the transfer roller bearing 121 also move in the direction away from the photosensitive drum 8.

The length by which the transfer roller 9 is pressed down is set to at least such a length that, as illustrated in FIG. 16B, the hook portion 114 of the transfer roller bearing 111 and the hook portion 124 of the transfer roller bearing 121 are positioned below the locking portion 312 and the locking portion 313 of the locking member 311.

Subsequently, as illustrated in FIG. 17A, the separating gear 331 is rotated in a direction of an arrow 342. In the second embodiment, the direction of the arrow 342 is opposite to the direction of driving in a normal operation. In the second embodiment, the separating gear 331 is rotated with an external force that is applied thereto by manually operating the lever 333.

When the separating gear 331 is rotated in the direction of the arrow 342, the stopper member 321 slides in a direction of an arrow 341 with the aid of the rack portion 323. In this step, as illustrated in FIG. 18, the locking member 311 is constantly urged in a predetermined direction by the separating spring 151. Therefore, the slide portion 315 keeps in contact with the sloping portion 324. Hence, the locking member 311 that moves by following the sliding of the stopper member 321 gradually moves in the direction of the arrow 15, i.e., a direction away from the stopper member 321.

As the locking member 311 slides in the direction of the arrow 15, the locking portion 312 and the locking portion 313 come to engage with the hook portion 114 of the transfer roller bearing 111 and the hook portion 124 of the transfer roller bearing 121, respectively, as illustrated in FIG. 17B. As illustrated in FIG. 19A, when the separating gear 331 is further rotated, the stopper member 321 further slides in the direction of the arrow 341 while the slide portion 315 climbs the sloping portion 324 and reaches the stopper portion 322 (as illustrated in FIG. 20). The position of the stopper member 321 in this step is defined as a first regulating position.

At the first regulating position, the contact portion 314 is in contact with the stopper portion 322. In this state, the locking portion 312 and the locking portion 313 perfectly engage with the hook portion 114 and the hook portion 124, respectively (as illustrated in FIG. 19B).

To move the stopper member 321 to an end position where the separating operation ends, the separating gear 331 is rotated by a certain extra angle, whereby the state of contact is stabilized.

Through the above operation, a force acting in the direction of the arrow 153 is applied to the locking member 311 by the separating spring 151. However, since the contact portion 314 and the stopper portion 322 are in contact with each other, the locking member 311 does not slide in the direction of the arrow 153.

Hence, to maintain the state of engagement of the locking portion 312 and the locking portion 313 with the hook portion 114 and the hook portion 124, respectively, the transfer roller 9 is maintained to be at a certain distance from the photosensitive drum 8.

Operation of Canceling Separation of Transfer Roller from Photosensitive Drum

Figure 21A:
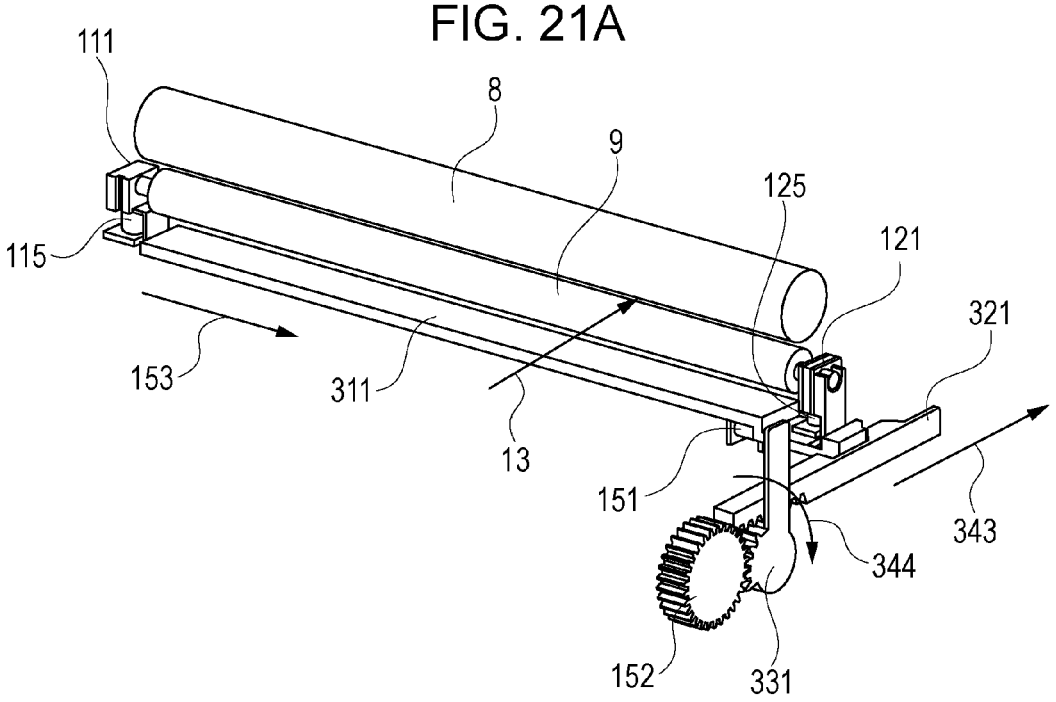
FIG. 21A is yet another schematic perspective view of the separating mechanism according to the second embodiment.
Figure 21B:
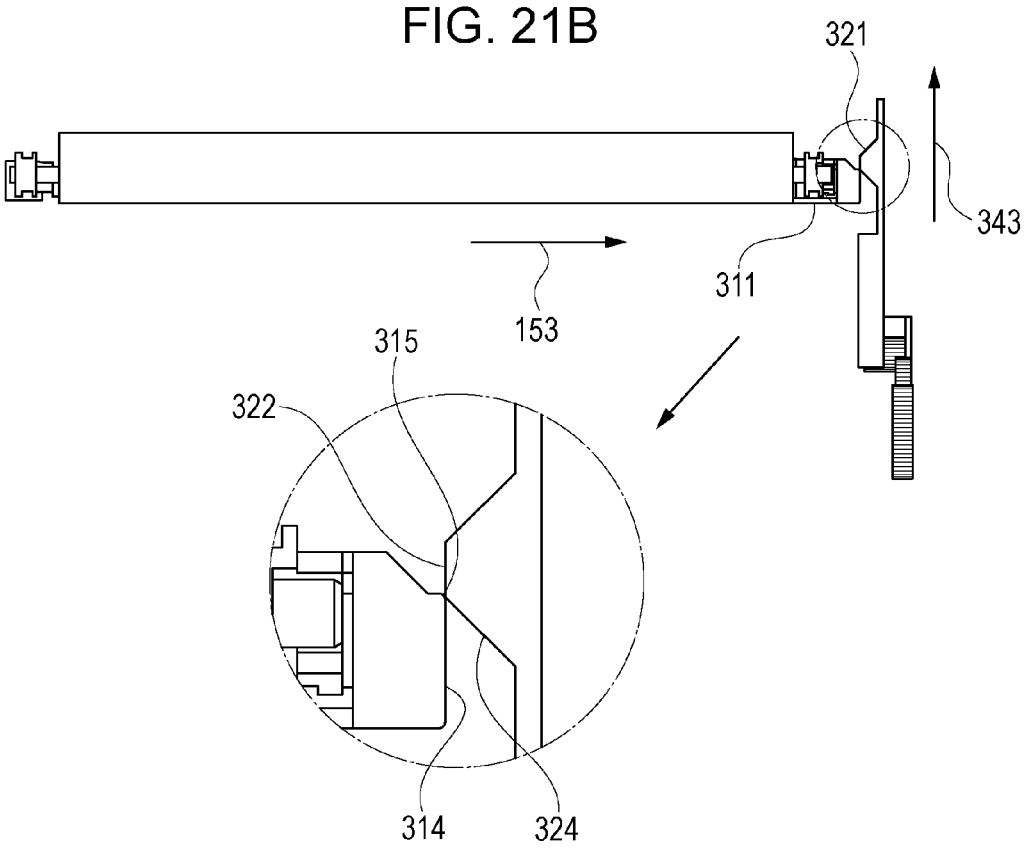
FIG. 21B illustrates a state of contact between the engaging member and the regulating member according to the second embodiment.
Figure 22A:
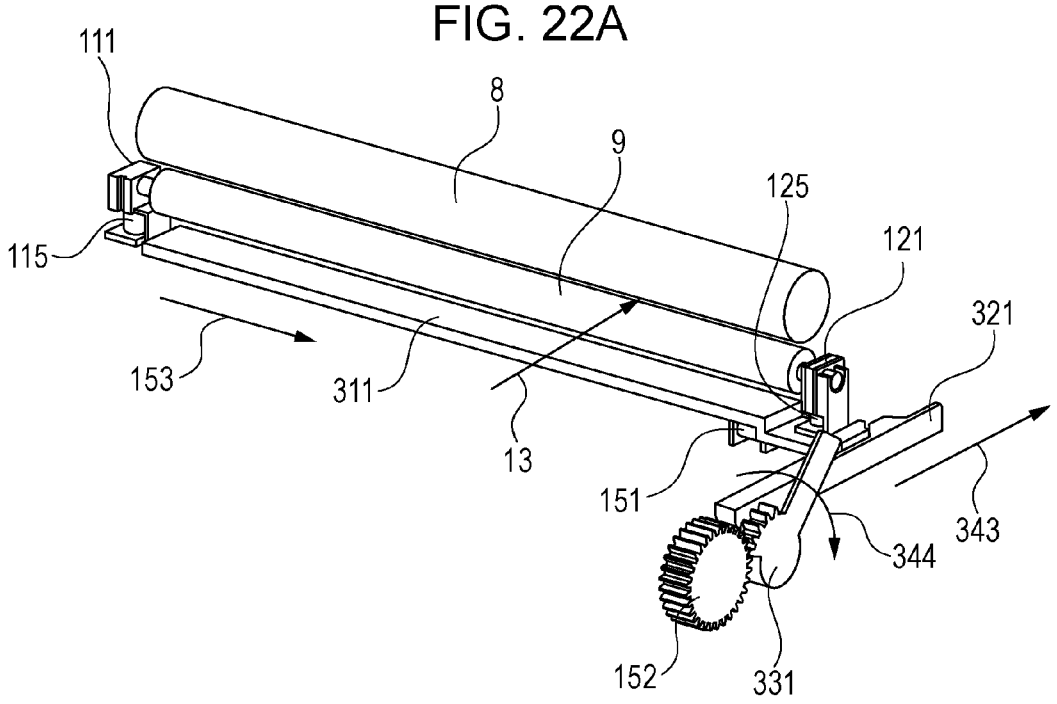
FIG. 22A is yet another schematic perspective view of the separating mechanism according to the second embodiment.
Figure 22B:
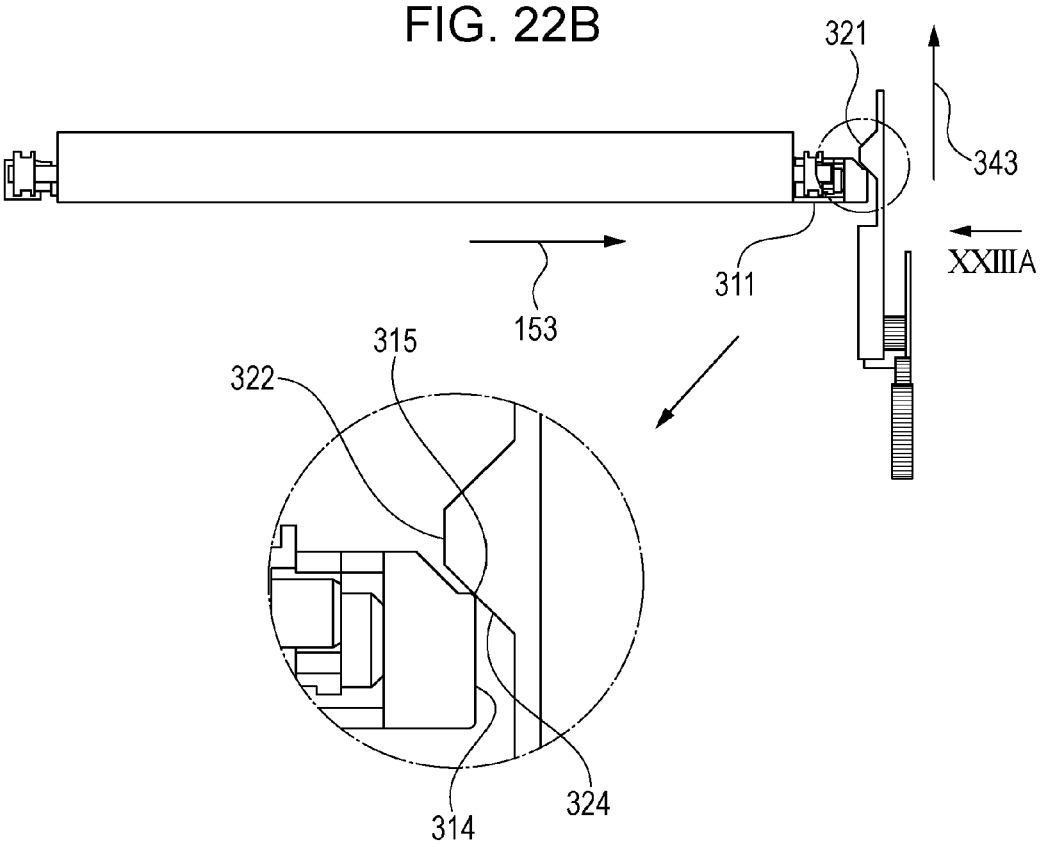
FIG. 22B illustrates another state of contact between the engaging member and the regulating member according to the second embodiment.
Figure 23A:
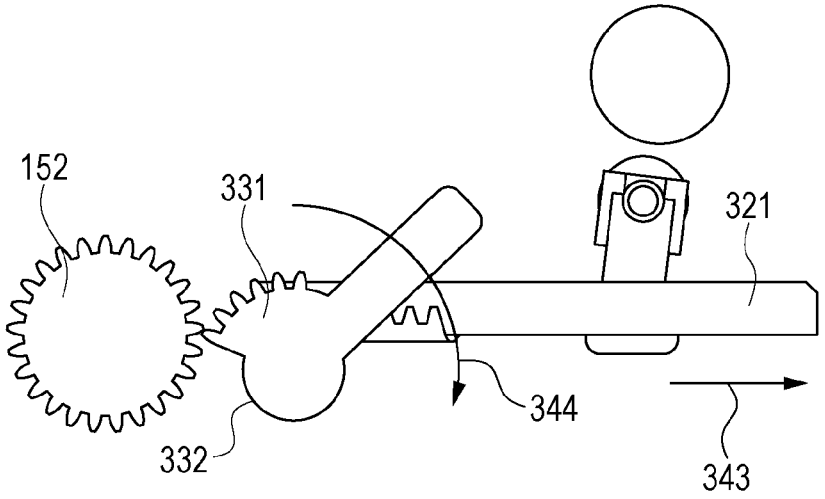
FIG. 23A is a sectional view illustrating the positional relationship between the regulating member and the engaging member according to the second embodiment that are seen in the axial direction.
Figure 23B:
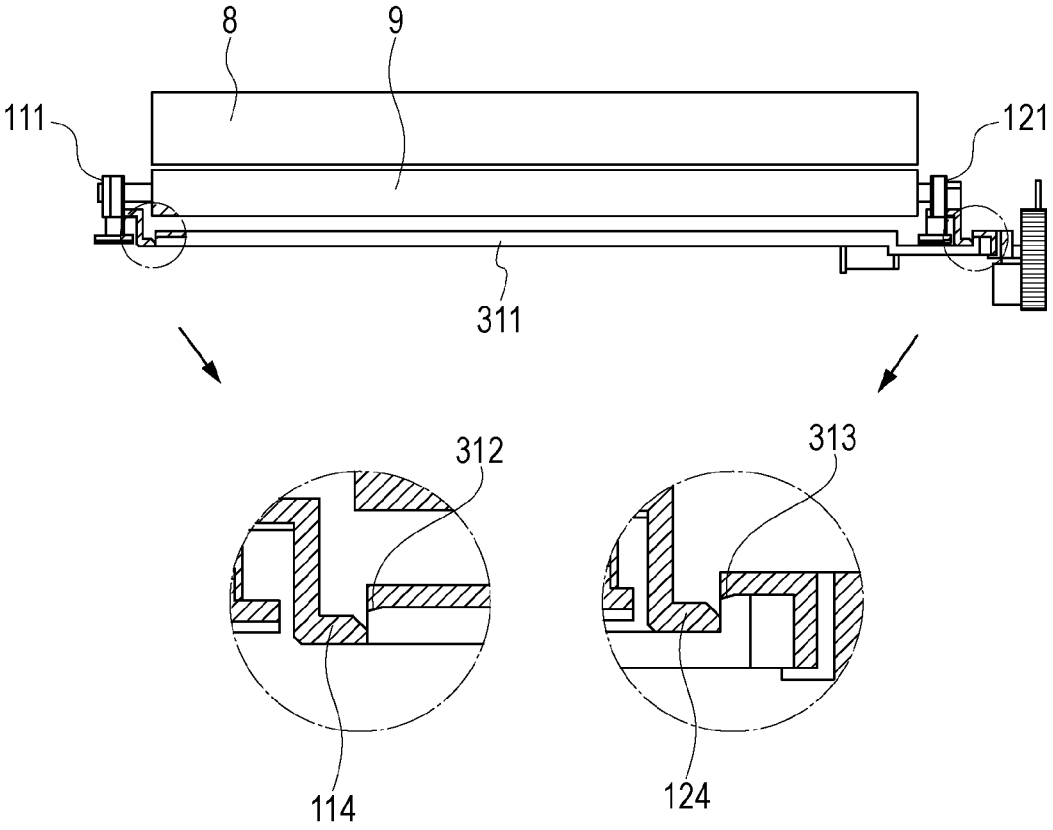
FIG. 23B is yet another schematic side view of the separating mechanism according to the second embodiment.
Figure 24A:
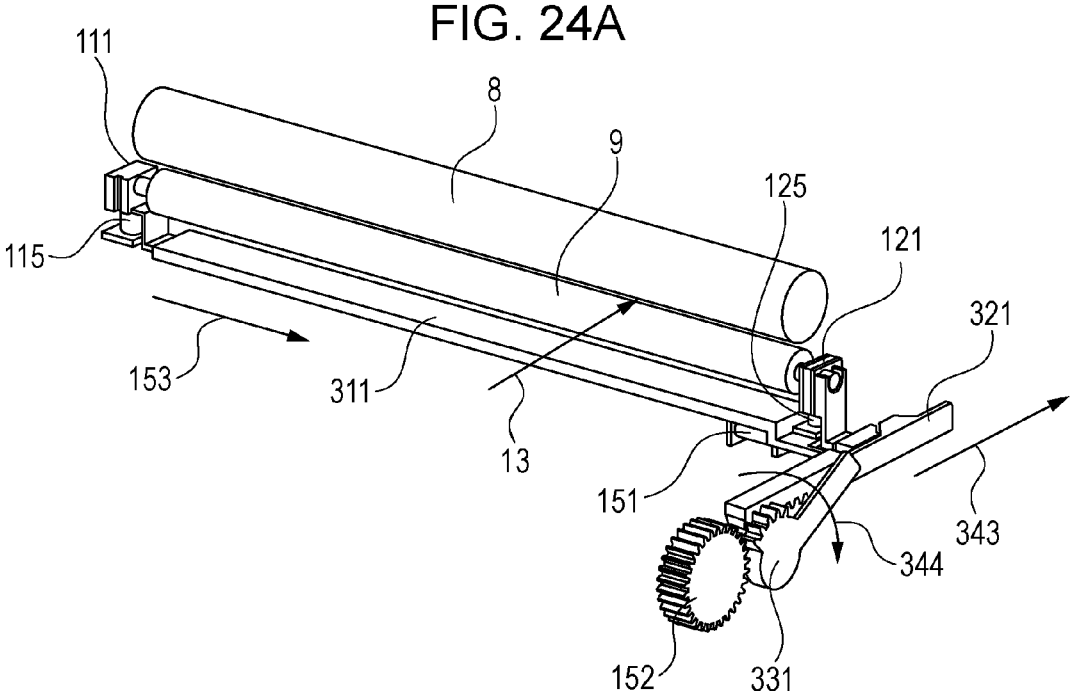
FIG. 24A is yet another schematic perspective view of the separating mechanism according to the second embodiment.
Figure 24B:
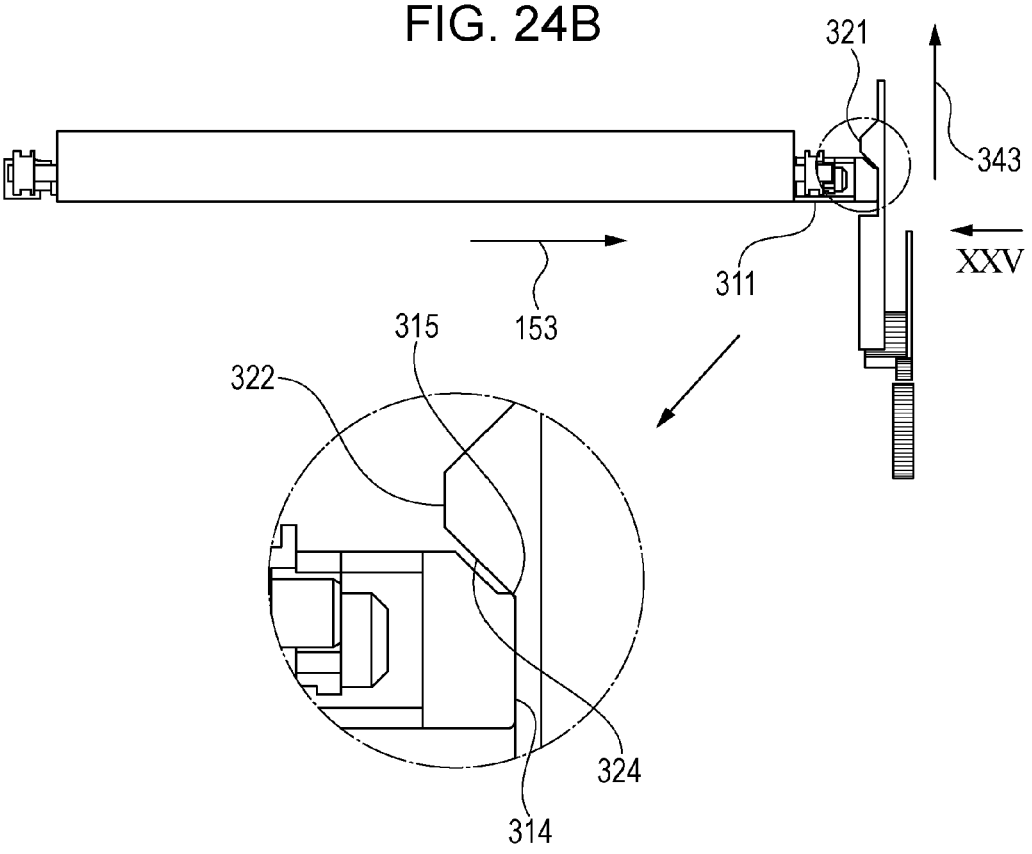
FIG. 24B illustrates yet another state of contact between the engaging member and the regulating member according to the second embodiment.
Figure 25:
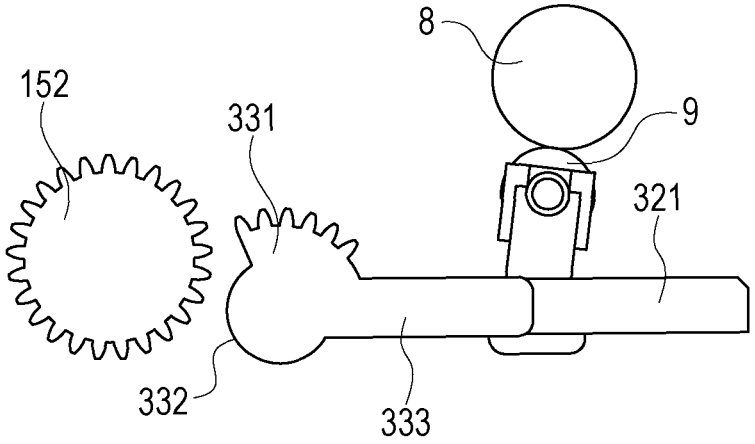
FIG. 25 is another sectional view illustrating the positional relationship between the regulating member and the engaging member according to the second embodiment that are seen in the axial direction.

An operation of moving the transfer roller 9 that has been in contact with the photosensitive drum 8 to a position away from the photosensitive drum 8 will now be described with reference to FIGS. 21A to 25. FIGS. 21A, 22A, and 24A are perspective views illustrating the operation of the separating mechanism. FIGS. 21B, 22B, and 24B each illustrate a state of contact between the locking member 311 and the stopper member 321 for illustrating the operation of the separating mechanism. FIGS. 23A and 25 illustrate the separating mechanism seen in the axial direction. FIG. 23B is a side view of the separating mechanism with portions thereof illustrated in enlarged view.

In the state where the transfer roller 9 and the photosensitive drum 8 are maintained to be separated from each other, the rotation of the precedent gear 152 is transmitted to the gear portion 334 of the separating gear 331 as illustrated in FIG. 21A, whereby the separating gear 331 rotates in a direction of an arrow 344. Then, the rotation of the separating gear 331 is transmitted to the rack portion 323 of the stopper member 321, whereby the stopper member 321 slides in a direction of an arrow 343 illustrated in FIG. 21A.

While the stopper member 321 is sliding, as illustrated in FIG. 21B, the contact portion 314 and the stopper portion 322 are kept in contact with each other because the locking member 311 is urged in the direction of the arrow 153 by the separating spring 151.

As illustrated in FIG. 22A, when the separating gear 331 is further rotated in the direction of the arrow 344, the slide portion 315 starts to be in contact with the sloping portion 324. In this step, the locking member 311 is urged in the direction of the arrow 153 by the separating spring 151. Therefore, while the slide portion 315 is kept in contact with the sloping portion 324, the locking member 311 slides in the direction of the arrow 153. When the separating gear 331 is further rotated in the direction of the arrow 344, the slide portion 315 is positioned substantially at the center of the sloping portion 324 as illustrated in FIG. 22B. At this point, the sliding of the locking member 311 causes the locking portion 312 and the locking portion 313 to be disengaged from the hook portion 114 and the hook portion 124, respectively. After the disengagement, the transfer roller 9 is pushed up toward the photosensitive drum 8 with the urging forces exerted by the spring 115 and the spring 125, whereby the separation is cancelled.

FIG. 23A illustrates the separating mechanism seen in the axial direction (in a direction of arrow XXIIIA illustrated in FIG. 22A). The gear portion 334 of the separating gear 331 that is configured to mesh with the precedent gear 152 includes the toothless portion 332. That is, after the separating gear 331 is rotated by a certain angle, the rotation of the separating gear 331 stops because the transmission of the driving force is disabled at the toothless portion 332. In the second embodiment, the angle of rotation at which the transmission of the driving force between the separating gear 331 and the precedent gear 152 is disabled at the toothless portion 332 is set to an angle at which the slide portion 315 is positioned substantially at the center of the sloping portion 324 as illustrated in FIG. 22B. That is, in the state illustrated in FIG. 22B, the locking portion 312 and the locking portion 313 are disengaged from the hook portion 114 and the hook portion 124, respectively, as illustrated in FIG. 23B and the transmission of the driving force to the separating gear 331 is disabled.

After the slide portion 315 and the sloping portion 324 are positioned as illustrated in FIG. 22B, the locking member 311 is further moved in the direction of the arrow 153 with the urging force exerted by the separating spring 151. In this step, the sloping portion 324 functions as a cam and causes the stopper member 321 to further slide in the direction of the arrow 343 as illustrated in FIG. 24B. The position of the stopper member 321 in this step is defined as a second regulating position. As illustrated in FIG. 24A, even after the transmission of the driving force from the main body to the separating gear 331 is disabled, the stopper member 321 is movable by a certain length. Therefore, with the movement of the stopper member 321, the separating gear 331 rotates by a certain angle.

FIG. 25 illustrates a state where the stopper member 321 has finished moving. In the second embodiment, this state is set such that the gear portion 334 of the separating gear 331 and the teeth of the precedent gear 152 that transmits the driving force from the main body are out of contact with each other with a certain gap interposed therebetween. With the rotation of the separating gear 331, the lever 333 and the transfer roller 9 are retracted.

As described above, in the second embodiment, the transfer roller 9 can be separated from the photosensitive drum 8 by moving the lever 333. To bring the transfer roller 9 into contact with the photosensitive drum 8, the separating gear 331 is rotated with the driving force transmitted thereto from the driving source provided in the main body. Thus, the stopper member 321 is slid, and the locking by the locking member 311 is canceled, whereby the transfer roller 9 comes into contact with the photosensitive drum 8. In this step, the lever 333 rotates by following the rotation of the separating gear 331. Hence, there is no need to operate the lever 333.

Accordingly, as in the first embodiment, the transfer roller 9 can be brought into pressure contact with the photosensitive drum 8 with no influence of the locking member 311 and the stopper member 321 upon the state of pressure contact and upon the rotation of the transfer roller 9. Furthermore, with the lever 333, the state of separation can be maintained by a simple operation, improving the ease of operation.

Other Embodiments

The first embodiment and the second embodiment each concern a case where the transfer roller 9 is separated from the photosensitive drum 8 by the separating mechanism. Alternatively, another member including a shaft portion may be separated from an object by the separating mechanism. For example, the separating mechanism according to the first embodiment or the second embodiment may also be employed as a separating mechanism that brings a processing member, such as the charging member 80 or the developing member 81, acting on the photosensitive drum 8 into contact with the photosensitive drum 8 or that separates the processing member from the photosensitive drum 8.

Although the locking member 131 or 311 as an engaging member is positioned across the transfer roller 9 from the photosensitive drum 8, the locking member 131 or 311 may be positioned in any other way, according to need, in a space provided in the main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image carrying member that carries a toner image;

a transfer unit that includes a transfer roller configured to transfer the toner image from the image carrying member to a recording material;

an engaging unit configured to separate the transfer roller from the image carrying member when the engaging unit engages with the transfer unit, the engaging unit being movable, in an axial direction of the transfer roller, from one end of the transfer roller toward the other end of the transfer roller or from the other end of the transfer roller to the one end of the transfer roller; and a stopper member configured to stop movement of the engaging unit, wherein the stopper member moves while stopping the movement of the engaging unit to thereby enable the engaging unit to move in the axial direction of the transfer roller and makes the engaging unit disengaged from the transfer roller.

2. The image forming apparatus according to claim 1, wherein the transfer rollers includes:

a first separating portion configured to separate an end of the transfer roller that is on one side of the image carrying member, and a second separating portion configured to separate an end of the transfer member that is on another side of the image carrying member.

3. The image forming apparatus according to claim 2, wherein the engaging unit includes a long engaging member in which a first engaging portion and a second engaging portion are integrated with each other, wherein the first engaging portion is configured to engage with the first separating portion, and the second engaging portion is configured to engage with the second separating portion.

4. The image forming apparatus according to claim 2, wherein the first separating portion includes:

a first bearing portion that supports an end of a shaft of the transfer roller that is on the one side, and a first hook portion that moves together with the first bearing portion, and wherein the second separating portion includes:

a second bearing portion that supports an end of the shaft of the transfer roller that is on the other side, and a second hook portion that moves together with the second bearing portion.

5. The image forming apparatus according to claim 1, further comprising an urging member that urges the engaging unit in the axial direction, wherein the urging member urges the engaging unit from the one side toward the other side of the engaging unit in the axial direction.

6. The image forming apparatus according to claim 1, wherein the stopper member is provided on the other side of the engaging unit in the axial direction.

7. The image forming apparatus according to claim 6, wherein the stopper member includes:

a gear portion configured to be rotated by receiving a driving force, and a contact receiving portion configured to come into contact with the engaging unit, wherein the gear portion has a partially toothless shape, and wherein, when the gear portion rotates by receiving the driving force, a phase of the stopper member changes from a first phase in which the contact receiving portion comes into contact with the engaging unit and regulates a position of the engaging unit to a second phase in which the contact receiving portion is out of contact with the engaging unit.

8. The image forming apparatus according to claim 7, further comprising a transmission device configured to transmit the driving force to the gear portion, wherein the transmission device is provided on the other side of the engaging unit in the axial direction.

9. The image forming apparatus according to claim 7, wherein the transfer member is positioned away from the image carrying member when the stopper member is in the first phase, and the transfer roller is in contact with the image carrying member when the stopper member is in the second phase.

10. The image forming apparatus according to claim 7, wherein the engaging unit includes a sloping portion that slopes with respect to the axial direction, wherein, when the stopper member moves from the first phase to the second phase, the stopper member rotates by a certain angle by receiving a force from the sloping portion of the engaging unit.

11. The image forming apparatus according to claim 8, wherein, after the stopper member has moved from the first phase to the second phase by receiving the driving force from the transmission device, a toothless portion of the stopper member faces the transmission device.

12. The image forming apparatus according to claim 1, wherein the image carrying member is a photosensitive drum on which an electrostatic latent image is to be formed.

13. The image forming apparatus according to claim 12, further comprising a cartridge that includes the photosensitive drum and that is detachably attached to a main body.

14. The image forming apparatus according to claim 13, wherein, even if the image forming apparatus is transported with the cartridge being on the main body, the transfer member is kept away from the photosensitive drum by the engaging unit.

15. The image forming apparatus according to claim 14, wherein, when a power supply of the main body is turned on, the engaging unit moves and the transfer member automatically comes into contact with the photosensitive drum.

* * * * *